US005190838A

United States Patent [19]

Saitoh et al.

[11] Patent Number: 5,190,838

[45] Date of Patent: Mar. 2, 1993

[54] ELECTROPHOTOGRAPHIC IMAGE-FORMING MEMBER WITH PHOTOCONDUCTIVE LAYER COMPRISING NON-SINGLE-CRYSTAL SILICON CARBIDE

[75] Inventors: Keishi Saitoh; Masafumi Sano; Koichi Matsuda, all of Nagahama, Japan

[73] Assignee: Canon Kabushiki Kaisha, Tokyo, Japan

[21] Appl. No.: 572,354

[22] Filed: Aug. 27, 1990

Related U.S. Application Data

[63] Continuation of Ser. No. 393,961, Aug. 15, 1989, abandoned.

[30] Foreign Application Priority Data

Aug. 18, 1988 [JP] Japan ..... 63-203831
Aug. 18, 1988 [JP] Japan ..... 63-203832
Aug. 18, 1988 [JP] Japan ..... 63-203833

[51] Int. Cl.[5] ..... G03G 5/14; G03G 5/082

[52] U.S. Cl. ..... 430/65; 430/67; 430/84; 430/85

[58] Field of Search ..... 430/57, 85, 86, 65, 430/67, 84

[56] References Cited

U.S. PATENT DOCUMENTS 4,882,252 11/1989 Kawamura ..... 430/65 X

*Primary Examiner*—Roland Martin
*Attorney, Agent, or Firm*—Fitzpatrick, Cella, Harper & Scinto

[57] ABSTRACT

An electrophotographic image-forming member which comprises a substrate for electrophotography and a light receiving layer being disposed on said substrate, said light receiving layer comprising a photoconductive layer formed of a non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared adsorption spectrum.

The light receiving layer may further comprise a charge injection inhibition layer or/and a surface layer.

The electrophotographic image-forming member can be used in a high-speed continuous electrophotographic copying systems using a coherent light laser beam as the light source without accompaniment of the problems which are found on conventional amorphous silicon carbide system electrophotographic image-forming members.

23 Claims, 12 Drawing Sheets

ELECTROPHOTOGRAPHIC IMAGE-FORMING MEMBER WITH PHOTOCONDUCTIVE LAYER COMPRISING NON-SINGLE-CRYSTAL SILICON CARBIDE

This application is a continuation of application Ser. No. 07/393,961 filed Aug. 15, 1989, now abandoned.

FIELD OF THE INVENTION

The present invention relates to an electrophotographic image-forming member having a photoconductive layer composed of a non-single-crystal silicon carbide material containing silicon atoms as a matrix, hydrogen atoms in an amount of 1 to 10 atomic % and carbon atoms in an amount of 5 to 15 atomic % and having an intensity ratio of 0.01 to 0.05 between the C—H bond stretching mode and the Si—H bond stretching mode in an infrared absorption spectrum. (The term "non-single-crystal material silicon carbide" is meant to include amorphous silicon carbide material including microcrystal silicon carbide material, and polycrystal silicon carbide material.)

BACKGROUND OF THE INVENTION

Hitherto, there have been various proposals for an electrophotographic image-forming member having a photoconductive layer composed of an amorphous silicon carbide. For example, in U.S. Pat. No. 4,539,283, there is disclosed a photoconductive member having an amorphous silicon layer containing carbon atoms in a distribution uneven in the layer thickness direction. In U.S. Pat. No. 4,677,044, there is disclosed a photosensitive member having a charge transporting layer comprised of an amorphous silicon carbide, a charge generating layer comprised of an amorphous silicon and a surface modifying layer comprised of an amorphous silicon carbide. And, in U.S. Pat. No. 4,673,629, there is disclosed a photoreceptor having a charge transport layer comprised of an amorphous silicon carbide, a charge generating layer comprised of an amorphous silicon, a surface modifying layer comprised of an amorphous silicon carbide and an interlayer comprised of an amorphous silicon carbide.

It is known that these known amorphous silicon carbide films can be prepared in accordance with a conventional high frequency plasma chemical vapor deposition process (RF PCVD process in short) in the same manner as in the case of preparing a hydrogenated amorphous silicon film in accordance with said RF-PCVD process.

In comparison with the known hydrogenated amorphous silicon films, any of those known amorphous silicon carbide films is inferior with the viewpoint that it is more or less accompanied with not only defects due to hydrogen atoms but also other defects due to double bonds of carbon atoms. Further, for those known silicon carbide films, although they have been evaluated as exhibiting a high dark resistance, they are still problematic in that carbon atoms incorporated therein are apt to cause an increase in the tail state in the conduction bond side depending upon the situation of carbon atoms to be incorporated, which results in decreasing the mobility of an electron. In this respect, there is a limit for those known amorphous silicon carbide films to be used as a constituent layer for an electrophotographic image-forming member.

That is, as for known electrophotographic image-forming members having a photoconductive layer composed of a known amorphous silicon carbide, their electrophotographic characteristics have been considered mostly against a light source containing long wavelength light such as tungsten halogen lamp, and their practically applicable characteristics have been evaluated upon photocarriers generated as a result of absorption of long wavelength light by their photoconductive layer as a whole.

The known electrophotographic image-forming members having a photoconductive layer composed of an amorphous silicon carbide are mostly of the type that comprises an amorphous silicon carbide layer and a charge generating layer being disposed under or on said amorphous silicon carbide layer, wherein a charge (photocarrier) generated in said charge generating layer is injected into said amorphous silicon carbide layer to thereby form an electrostatic latent image. These known electrophotographic image-forming members have been usually considered as being practically usable as long as at least either electrons or holes in their amorphous silicon carbide layer have a sufficient carrier range.

Thus, it can be said that the known amorphous silicon carbide films have a practical applicability when used as the photoconductive layer of a photosensitive image-forming member for use in an ordinary-speed electrophotographic copying system or in an ordinary-speed printing system.

However, any of the known electrophotographic image-forming members having a constituent layer formed of a known amorphous silicon carbide film are not sufficient to satisfy all the requirements for an electrophotographic image-forming member for use in a high-speed electrophotographic copying system using a coherent light laser beam as the light source or in a high-speed printing system.

For example, for a known electrophotographic image-forming member having a photoconductive layer formed of a known amorphous silicon carbide film, when it is used in said high-speed electrophotographic copying system and the electrophotographic image-forming process including corona-charging operation and exposing operation is continuously repeated, there often occur pinholes thereon due to repeated corona charging operations at high speed to cause the formation of defective images. In this case, there also often appear ghosts on the resulting copied images.

Further, the electrophotographic image-forming process in the foregoing high-speed electrophotographic copying system is relatively complicated in order to repeatedly provide a high quality image at high speed. There is a problem for the foregoing known amorphous silicon carbide image-forming member when used in such complicated electrophotographic image-forming process in that dark decay is apt to occur because of repeated corona-charging operations at high speed.

Further in addition, in the foregoing electrophotographic image-forming process, corona-charging, image-exposure, development, image-transfer, and cleaning are continuously repeated at high speed. In that process pre-exposure is conducted to eliminate the residual potential resulted from the previous image-pattern prior to conducting said corona-charging. There is a problem for the foregoing known amorphous silicon carbide image-forming member in this that electrons and holes are apt to be trapped within its photoconductive layer respectively in a large quantity because of said pre-exposure. Those electrons and holes once trapped within the photoconductive layer are released at the time of corona-charging to cause a decrease in the initial surface electric potential, which leads to increase in a dark decay for the image-forming member. In this case, there is another problem in that those electrons and holes as trapped within the photoconductive layer are apt to recombine with electrons and holes generated at the time of image-exposure to cause a decrease in the photosensitivity of the image-forming member.

As for the known amorphous silicon carbide film, when it is formed by way of a conventional RF-PCVD process, there is a problem when the deposition rate is 80Å/sec. or more, in that the electric characteristics of the resulting amorphous silicon carbide film become significantly reduced.

Further in addition, in the case of the known electrophotographic image-forming member having a photoconductive layer formed of a known amorphous silicon carbide film and a surface layer laminated on said photoconductive layer, when it is used in the foregoing high-speed electrophotographic copying system, the charge retentivity is relatively satisfactory in comparison to a member not having any surface layer, but because the rotation cycle is short, the surface electric potential is gradually decreased as corona-charging is repeated to cause a phenomenon called "a decrease in the initial surface electric potential". Occurrence of this phenomenon is different in terms of degree between the part of the photoconductive layer which was irradiated with light and the remaining part which was not irradiated with light. This causes appearance of a significant ghost on an image obtained.

It is commonly recognized that an electrophotographic image-forming member can be provided with a charge injection inhibition layer in order to prevent charges from being injected into the photoconductive layer from the side of the substrate. However there is a problem for an electrophotographic image-forming member comprising a substrate and a light receiving layer comprising a charge injection inhibition layer and a photoconductive layer formed of a known amorphous silicon carbide film being laminated in this order on said substrate when used in the foregoing high-speed electrophotographic copying system in that pinholes are apt to occur on the image-forming member because the electrophotographic image-forming process is continuously repeated at high speed and the related conditions including charging condition eventually become severe.

Against the above background, high-speed electrophotographic copying systems gradually have come into wide use. There is an increased social demand for providing an inexpensive desirable electrophotographic image-forming member which can sufficiently satisfy the requirements for such high-speed copying systems and which can stably exhibit the desired functions as the electrophotographic image-forming member for said systems, by using an amorphous silicon carbide film and utilizing the various advantages thereof.

SUMMARY OF THE INVENTION

The present invention is aimed at eliminating the foregoing problems for the conventional amorphous silicon carbide system electrophotographic image-forming members. The present invention provides an inexpensive and improved non-single-crystal silicon carbide system electrophotographic image-forming member which can be used in a high-speed continuous electrophotographic copying systems using a coherent light laser beam as the light source without the accompaniment of the foregoing problems and which can comply with the aforementioned demands.

Another object of the present invention is to provide an improved electrophotographic image-forming member having a light receiving layer formed of a specific non-single-crystal silicon carbide film excelling in electric characteristics and having a sufficiently long carrier range for both electrons and holes which can be stably obtained even at a high deposition rate i.e. 80Å/sec or more.

Another object of the present invention is to provide an improved non-single-crystal silicon carbide image-forming member which is free of the foregoing problem relating to occurrence of pinholes which is found on the known amorphous silicon carbide system electrophotographic image-forming members.

A further object of the present invention is to provide an improved non-single-crystal silicon carbide system electrophotographic image-forming member which makes it possible to repeatedly and stably reproduce desirable images with no accompaniment of ghost.

A still further object of the present invention is to provide an improved non-single-crystal silicon carbide system electrophotographic image-forming member which is free of reductions in the initial surface potential which are found on the known amorphous silicon carbide system electrophotographic image-forming members upon being repeatedly employed in charging and image-exposure, and which makes it possible to repeatedly and stably reproduce desirable images even when used in the foregoing high-speed electrophotographic copying system.

The present invention which attains the above objects includes the following four representative embodiments.

According to the first embodiment of the present invention, there is provided an electrophotographic image-forming member which comprises a substrate and a light receiving layer being disposed on said substrate, said light receiving layer comprising a photoconductive layer formed of a non-single-crystal silicon carbide film containing silicon atoms as a matrix, carbon atoms in an amount of 5 to 15 atomic % and hydrogen atoms in an amount of 1 to 10 atomic %, containing graphite structural domains in a proportion of 1% or less per unit volume and having an intensity ratio of 0.01 to 0.05 between the C—H bond stretching mode and the Si—H bond stretching mode in an infrared absorption spectrum.

According to the second embodiment of the present invention, there is provided an electrophotographic image-forming member which comprises a substrate and a light receiving layer being disposed on said substrate, said light receiving layer comprising a charge injection inhibition layer and a photoconductive layer being laminated in this order from the side of said substrate, and each of said charge injection inhibition layer and said photoconductive layer being formed of a non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum.

According to the third embodiment of the present invention, there is provided an electrophotographic image-forming member which comprises a substrate and a light receiving layer being disposed on said substrate, said light receiving layer comprising a photoconductive layer and a surface layer being laminated in this order from the side of said substrate: said photoconductive layer being formed of a non-single-crystal silicon carbide film containing silicon atoms as a matrix, carbon atoms in an amount of 5 to 15 atomic % and hydrogen atoms in an amount of 1 to 10 atomic %, containing graphite structural domains in a proportion of 1% or less per unit volume and having an intensity ratio of 0.01 to 0.05 between the C—H bond stretching mode and the Si—H bond stretching mode in an infrared absorption spectrum: and said surface layer being formed of a non-single-crystal silicon carbide film containing silicon atoms as a matrix, carbon atoms in an amount of 20 to 40 atomic % and hydrogen atoms 50 to 70 atomic % and containing graphite structural domains in a proportion of 1% or less per unit volume.

According to the fourth embodiment of the present invention, there is provided an electrophotographic image-forming member that the foregoing electrophotographic image-forming member of the third embodiment according to the present invention further comprises a charge injection inhibition layer being interposed between the substrate and the photoconductive layer: said charge injection inhibition layer being formed of a non-single-crystal silicon carbide film containing silicon atoms as a matrix, carbon atoms in an amount of 5 to 15 atomic %, hydrogen atoms in an amount of 1 to 10 atomic %, and atoms of an element of the group III or the group V of the Periodic Table, containing graphite structural domains in a proportion of 1% or less per unit volume and having an intensity ratio of 0.01 to 0.05 between the C—H bond stretching mode and the Si—H bond stretching mode in an infrared absorption spectrum.

Any of the foregoing representative electrophotographic image-forming members according to the present invention surpasses any of the known amorphous silicon carbide system electrophotographic image-forming members in view of electrophotographic characteristics and is free of the foregoing problems relating to charge retentivity, dark decay, photosensitivity, appearance of ghosts, etc. which are found on the known amorphous silicon carbide system electrophotographic image-forming members.

Any of the foregoing representative electrophotographic image-forming members according to the present invention is well suited for use in a high-speed electrophotographic copying system which makes it possible to continuously and stably reproduce desirable images without occurrence of any of the foregoing problems relating to occurrence of pinholes, occurrence of a decrease in the initial surface potential, etc. which are found on the known amorphous silicon carbide system electrophotographic image-forming members when used in a high-speed electrophotographic copying system, even upon continuously repeated use for a long period of time.

DETAILED DESCRIPTION OF THE INVENTION

Figure 1A:
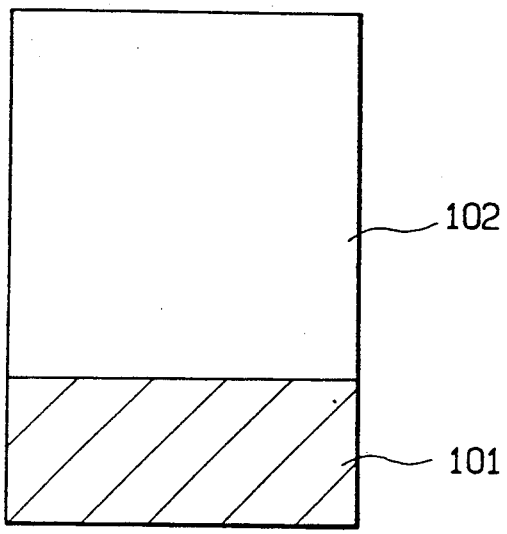
FIGS. 1(A) through 1(D) are schematic cross-sectional views illustrating representative embodiments of an electrophotographic image-forming member to be provided according to the present invention.

Representative embodiments of the electrophotographic image-forming member according to the present invention will now be explained more specifically referring to the drawings. The description is not intended to limit the scope of the present invention.

Representative electrophotographic image-forming members according to the present invention are as shown in FIG. 1(A) through FIG. 1(D), in which are shown substrate 101, photoconductive layer 102, charge injection inhibition layer 103, and surface layer 104.

FIG. 1(A) is a schematic view illustrating the typical layer constitution of the electrophotographic image-forming member according to the present invention which comprises a substrate 101 for electrophotography and a light receiving layer comprising a photoconductive layer 102 being disposed on said substrate 101, said photoconductive layer 102 being formed of a non-single-crystal silicon carbide film containing silicon atoms as a matrix, carbon atoms in an amount of 5 to 15 atomic % and hydrogen atoms in an amount of 1 to 10 atomic %, containing graphite structural domains in a proportion of 1% or less per unit volume and having an intensity ratio of 0.01 to 0.05 between the C—H bond stretching mode and the Si—H bond stretching mode in an infrared absorption spectrum.

Figure 1B:
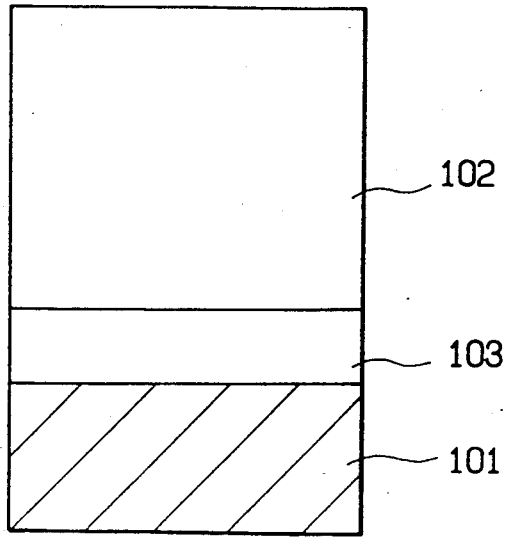

FIG. 1(B) is a schematic view illustrating another representative layer constitution of the electrophotographic image-forming member according to the present invention which comprises a substrate 101 for electrophotography and a light receiving layer being disposed on said substrate 101, said light receiving layer comprising a charge injection inhibition layer 102 and a photoconductive layer 102 being laminated in this order from the side of said substrate 101. The charge injection inhibition layer 103 is formed of a p-type or n-type non-single-crystal silicon-containing film, and the photoconductive layer 102 is formed of the same non-single-crystal silicon carbide film as in the case of FIG. 1(A). In a preferred embodiment of this case, the charge injection inhibition layer 103 is formed of a non-single-crystal silicon carbide film containing silicon atoms as a matrix, carbon atoms in an amount of 5 to 15 atomic %, hydrogen atoms in an amount of 1 to 10 atomic %, and atoms of an element of the group III or the group V of the Periodic Table, containing graphite structural domains in a proportion of 1% or less per unit volume and having an intensity ratio of 0.01 to 0.05 between the C—H bond stretching mode and the Si—H bond stretching mode in an infrared absorption spectrum.

Figure 1C:
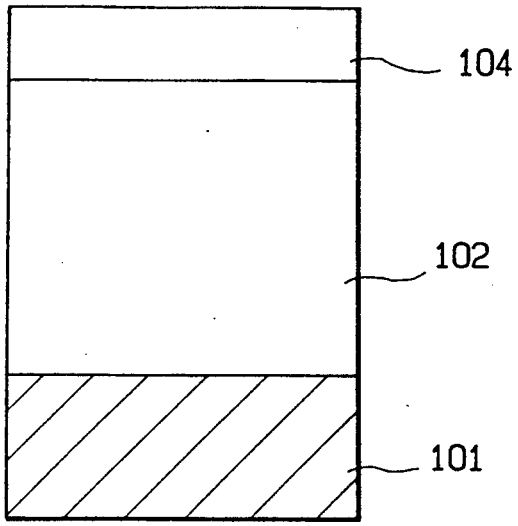

FIG. 1(C) is a schematic view illustrating another representative layer constitution of the electrophotographic image-forming member according to the present invention which comprises a substrate 101 for electrophotography and a light receiving layer being disposed on said substrate 101, said light receiving layer comprising a photoconductive layer 102 and a surface layer 104 being laminated in this order from the side of said substrate 101. The photoconductive layer 102 is formed of the same non-single-crystal silicon carbide film as in the case of FIG. 1(A), and the surface layer 104 is formed of a non-single-crystal silicon-containing film. In a preferred embodiment of this case, the surface layer 104 is formed of a non-single-crystal silicon carbide film containing silicon atoms as a matrix, carbon atoms in an amount of 20 to 40 atomic % and hydrogen atoms in an amount of 50 to 70 atomic % and containing graphite structural domains in a proportion of 1% or less per unit volume.

Figure 1D:
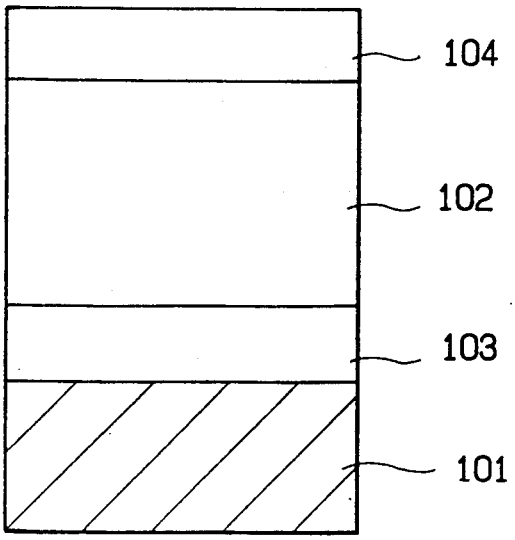

FIG. 1(D) is a schematic view illustrating another representative layer constitution of the electrophotographic image-forming member according to the present invention which comprises a substrate 101 and a light receiving layer being disposed on said substrate 101, said light receiving layer comprising a charge injection inhibition layer 103, a photoconductive layer 102 and a surface layer 104 being laminated in this order from the side of said substrate 101. The charge injection inhibition layer 103 is formed of the same film as that for the charge injection inhibition layer in the case of FIG. 1(B). The photoconductive layer 102 is formed of the same non-single-crystal silicon carbide film as in the case of FIG. 1(A). The surface layer 104 is formed of the same film as that for the surface layer in the case of FIG. 1(C). In a preferred embodiment of this case, the charge injection inhibition layer 103 is formed of a non-single-crystal silicon carbide film containing silicon atoms as a matrix, carbon atoms in an amount of 5 to 15 atomic %, hydrogen atoms in an amount of 1 to 10 atomic %, and atoms of an element of the group III or the group V of the Periodic Table, containing graphite structural domains in a proportion of 1% or less per unit volume and having an intensity ratio of 0.01 to 0.05 between the C—H bond stretching mode and the Si—H bond stretching mode in an infrared absorption spectrum. And the surface layer 104 is formed of a non-single-crystal silicon carbide film containing silicon atoms as a matrix, carbon atoms in an amount of 20 to 40 atomic % and hydrogen atoms 50 to 70 atomic % and containing graphite structural domains in a proportion of 1% or less per unit volume.

Now, an explanation will be provided for the substrate and each constituent layer in the electrophotographic image-forming member of the present invention.

Substrate 101

The substrate 101 for use in this invention may either be electroconductive or insulative. The electroconductive substrate can include, for example, metals such as NiCr, stainless steels, Al, Cr, Mo, Au, Nb, Ta, V, Ti, Pt and Pb or the alloys thereof.

The electrically insulative substrate can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses.

For instance, in the case of using the electrophotographic image-forming member shown in FIG. 1 in continuous high-speed reproduction, it is desirably configurated into an endless belt or cylindrical form.

The thickness of the substrate member is properly determined so that the electrophotographic image-forming member can be formed as desired.

In the case where flexibility is required for the electrophotographic image-forming member, it can be made as thin as possible within a range capable of sufficiently providing the function as the substrate. However, the thickness is usually greater than 10 μm in view of the fabrication and handling or mechanical strength of the substrate.

It is possible for the surface of the substrate to be uneven in order to eliminate occurrence of defective images caused by a so-called interference fringe pattern being apt to appear in the formed images in the case where the image-forming process is conducted using coherent monochromatic light such as laser beams.

Photoconductive Layer 102

It is an essential factor for the electrophotographic image-forming member of the present invention to have the photoconductive layer 102 being formed of a specific non-single-crystal silicon carbide film in order to attain the object of the present invention.

Said specific non-single-crystal silicon carbide film is defined by employing silicon atoms as a matrix, carbon atoms in an amount of 5 to 15 atomic % and hydrogen atoms in an amount of 1 to 10 atomic %, providing graphite structural domains in a proportion of 1% or less per unit volume and having an intensity ratio of 0.01 to 0.05 between the C—H bond stretching mode and the Si—H bond stretching mode in an infrared absorption spectrum.

The present invention has been accomplished as a result of extensive studies by the present inventors on a photoconductive layer composed of a non-single-crystal silicon carbide material.

That is, the present inventors have made various studies principally on the optical attenuation process of a surface electric potential for a photoconductive layer composed of a non-single-crystal silicon carbide material in an electrophotographic image-forming member, which is commonly recognized as being one of the most appropriate factors in order to evaluate of how much an electrophotographic image-forming member is effective.

Hereunder, the results obtained through the aforesaid studies by the present inventors are to be described.

The present inventors have thought in the following way with respect to the optical attenuation for the photoconductive layer under positive charge in the electrophotographic image-forming process.

The primary photocurrent of positive hole in the photoconductive layer can be by the equation:

$$J_h = \frac{eF\bar{x}}{L}$$

where $J_h$ is a photocurrent by a positive hole, L is a thickness of the photoconductive layer, $\bar{x}$ is an average mobilized distance of a positive hole, F is a quantity of light irradiated, and e is an elementary electric charge.

And it is presumed that the number of positive holes photoexcited in the photoconductive layer is attenuated in the way expressed by the equation:

$$N_h(X) = NO_h \exp\left(-\frac{x}{W_h}\right)$$

where $N_h(X)$ is the number of positive holes at the position x in the photoconductive layer, $W_h$ is a range of a positive hole (equals to the product of $\mu_h \tau_h E$, wherein $\mu_h$ is the mobility of a positive hole, $\tau_h$ is a life span of a positive hole, E is an electric field), and $NO_h$ is the number of positive holes primarily photoexcited. In this connection, the average mobilized distance $\bar{x}$ till the position x in the photoconductive layer can be expressed by the equation:

$$\bar{x} = \frac{1}{NO}\int_0^x x\left(\frac{dn_h}{dh}\right)dx + \frac{1}{NO}\, xNO_h \exp\left(-\frac{x}{W_h}\right)$$
$$= W_h\left\{1 - \exp\left(-\frac{x}{W_h}\right)\right\}$$

In consequence, the photocurrent $J_h$ by positive holes can be expressed by the equation:

$$J_h = \frac{eFW_h}{L}\left\{1 - \exp\left(\frac{x}{W_h}\right)\right\}$$

Further, in the case where the light absorption in the photoconductive layer corresponds to the equation: $F = F_o \exp(-\alpha x)$, where $F_o$ is a quantity of light irradiated, $\alpha$ is an extinction coefficient and x is a certain position in the photoconductive layer, the photocurrent by positive hole can be expressed by the following equation (1):

$$J_h = F_o e \frac{W_h}{L}\left\{1 - \exp(-\alpha L) + \frac{\alpha}{\alpha - \frac{1}{W_h}}\left(\exp(-\alpha L) - \exp\left(-\frac{L}{W_h}\right)\right)\right\} \quad (1)$$

Likewise, the current Je by electrons can be expressed by the following equation (2):

$$Je = F_o e \frac{We}{L}\left\{1 - \exp(-\alpha L) - \frac{\alpha}{\alpha + \frac{1}{We}}\left(1 - \exp\left(-1\alpha + \frac{1}{We}\right)L\right)\right\} \quad (2)$$

where We is a range of electron (equals to the product of $\mu_e \tau_h E$, wherein $\mu_e$ is the mobility of an electron, $\tau_h$ is a life span of an electron, and E is an electric field).

In view of the above, the total current J can be expressed by the equation: $J = J_e + J_h$.

From what above mentioned, the total current J can be obtained by the equation:

$$J = -c\frac{dv}{dt},$$

where C is a volume of the photoconductive layer, V is a surface electric potential and t is a lapse of time.

Then, the optical attenuation of a surface electric potential with respect to the photoconductive layer can be obtained by the following equation (3):

$$\int_{V_o}^{V} \frac{c}{J}\, dV = -t \quad (3)$$

where $V_o$ is an initial surface electric potential of the photoconductive layer.

Based on the above situation, the present inventors have firstly examined an optical attenuation curve for an electrophotographic image-forming member having a photoconductive layer being formed of a known amorphous silicon carbide film which was prepared in the later described Comparative Example 2 wherein RF glow discharge decomposition method was employed.

The measurement of an optical attenuation for the resultant electrophotographic image-forming member was carried out by a known method as disclosed in Photographic Science and Engineering Vol. 24, No. 5, p. 25, Sep./Oct., 1980.

Figure 2:
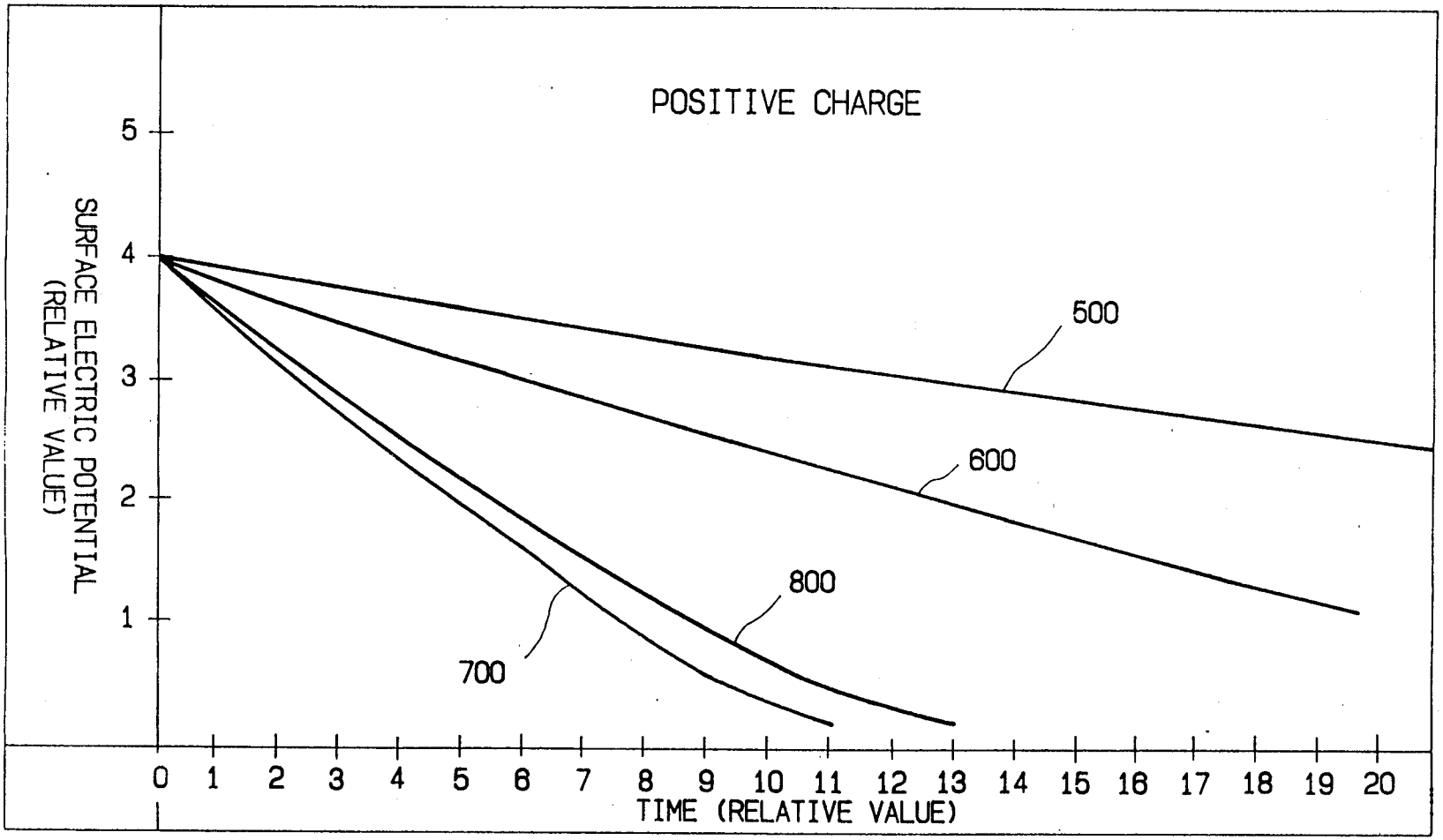
FIG. 2 shows optical attenuation curves for a surface electric potential relative to the lapse of time under positive charge on a known amorphous silicon carbide system electrophotographic image-forming member.
Figure 3:
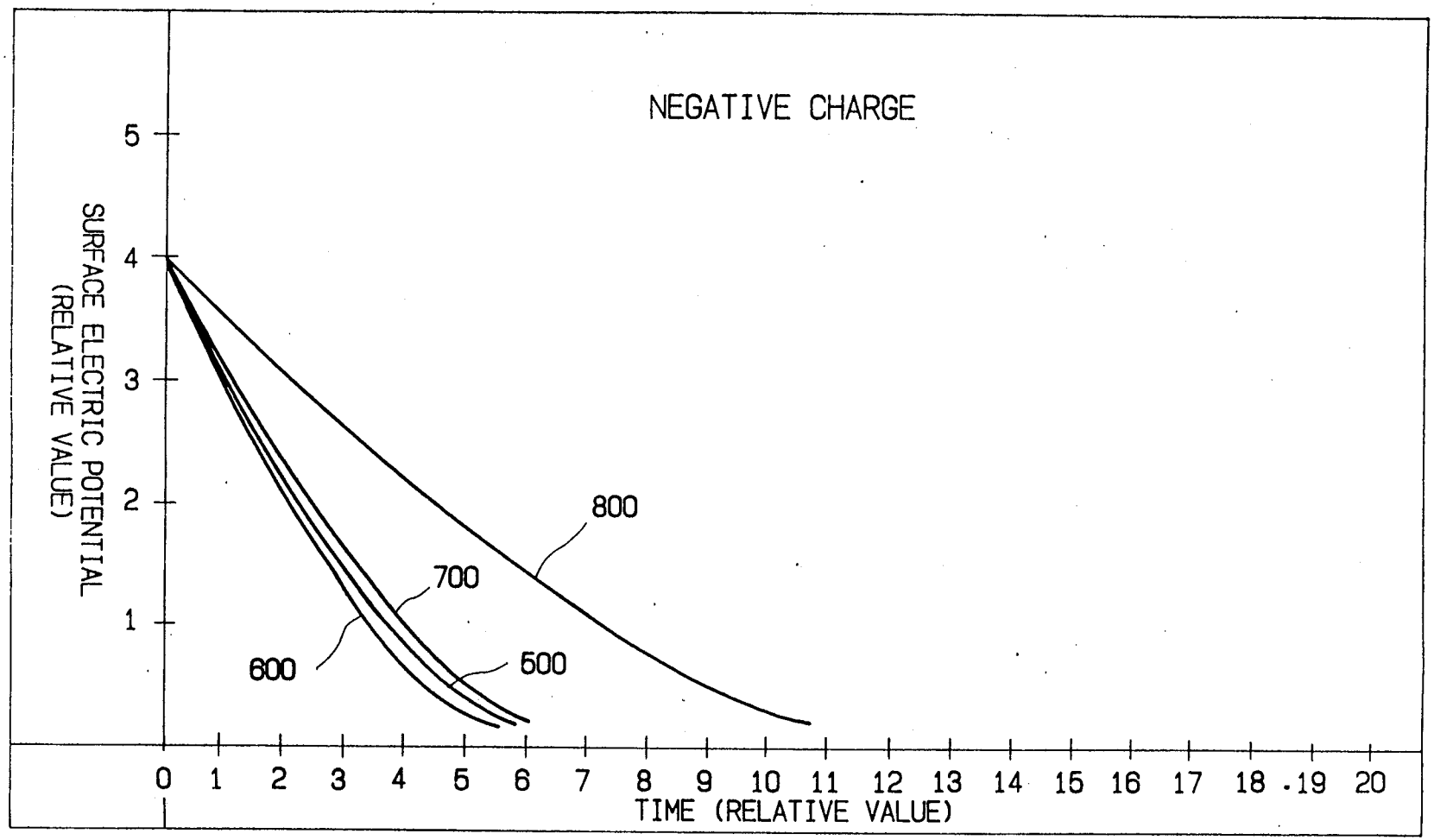
FIG. 3 shows optical attenuation curves for a surface electric potential relative to the lapse of time under negative charge on a known amorphous silicon carbide system electrophotographic image-forming member.

As a result, there were obtained an optical attenuation curve under positive corona charge as shown in FIG. 2 and another optical attenuation curve under negative corona charge as shown in FIG. 3.

From the resultant two optical attenuation curves, it has been found that in the case where the wavelength of light for exposure is short, the optical attenuation in positive corona charge is smaller than that in negative corona charge.

It has been thought that the electrophotographic image-forming member would show a proper optical attenuation against light containing long wavelength light such as light from tungsten halogen lamp.

The results shown in FIGS. 2 and 3 were discussed on the basis of the foregoing equations (1), (2) and (3). As a result, it has been presumed that the product of the positive hole's mobility and the positive hole's life span (hereinafter referred to as "$\mu\tau$ product") is smaller than that of the electron's mobility and the electron's life span.

Likewise, an optical attenuation was examined on an electrophotographic image-forming member having a photoconductive layer being formed of a specific non-single-crystal silicon carbide film prepared as Sample No. 011 in the later described Example 1, which is corresponding to the electrophotographic image-forming member according to the present invention. As a result, there were obtained an optical attenuation curve under positive corona charge as shown in FIG. 4 and another optical attenuation curve under negative corona charge as shown in FIG. 5.

Figure 4:
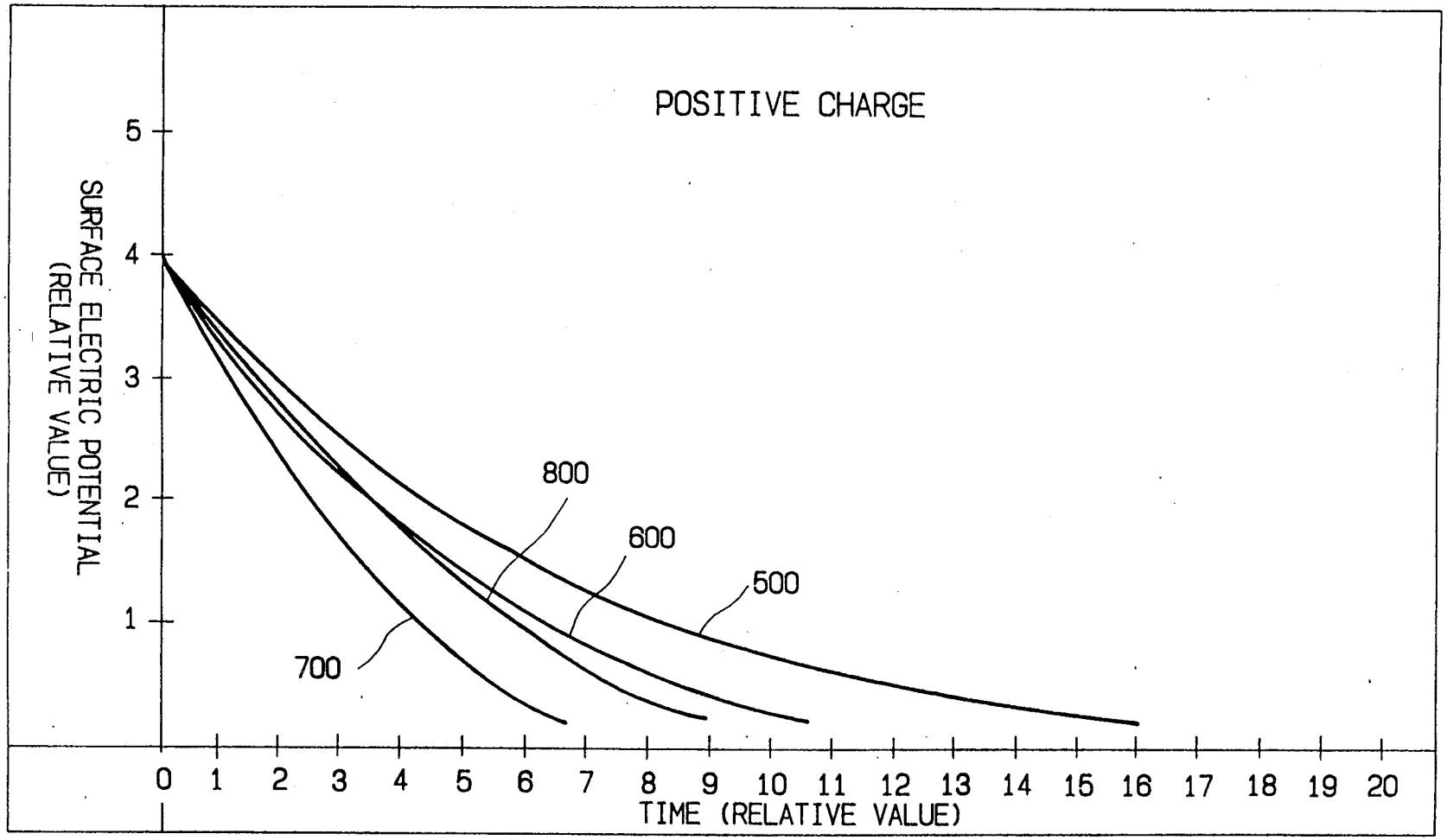
FIG. 4 shows optical attenuation curves for a surface electric potential based on lapse of time under positive charge on a non-single-crystal silicon carbide system electrophotographic image-forming member according to the present invention.
Figure 5:
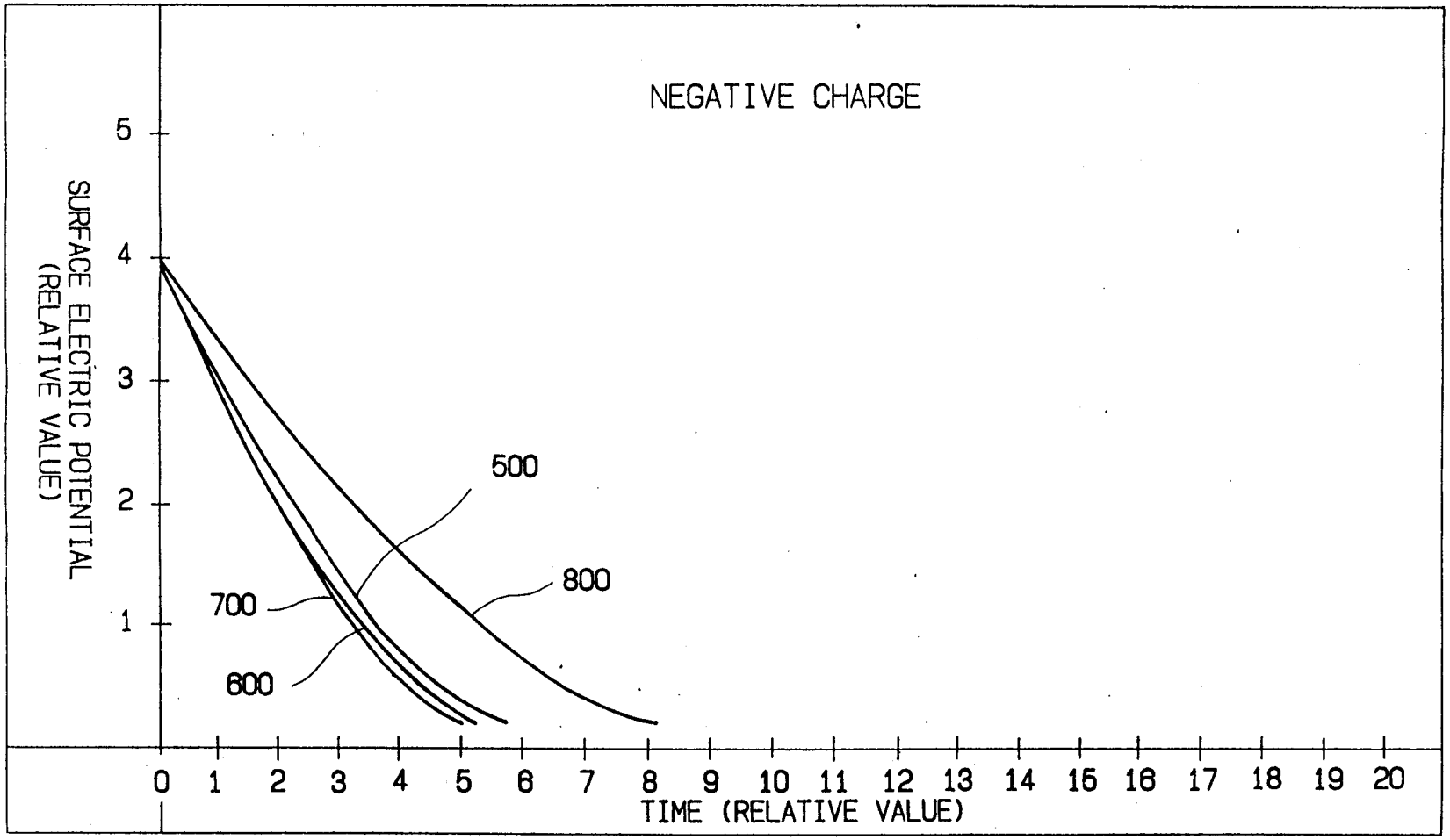
FIG. 5 shows optical attenuation curves for a surface electric potential relative to the lapse of time under negative charge on a non-single-crystal silicon carbide system electrophotographic image-forming member according to the present invention.

The results shown in FIG. 4 and FIG. 5 were discussed on the basis of the foregoing equations (1), (2) and (3). As a result, it has been found that the $\mu\tau$ product with respect to positive hole is superior to that of the conventional electrophotographic image-forming member.

By the way, it is known that in a non-single-crystal silicon carbide film such as a—SiC:H film, the hydrogen atoms contained therein serve to compensate the dangling bonds of the silicon atoms. However, in the case where there are contained hydrogen atoms in an excessive amount, those excessive hydrogen atoms are likely to break the bonds serving to form three dimensional networks among silicon atoms and/or among silicon and carbon atoms, whereby the strength of its film structure is reduced. Further, it is known that the hydrogen atom bonded to silicon atom serves to form a bonding orbital near the upper portion of a valence electron band to thereby increase a forbidden band width. However, in the case where there are contained hydrogen atoms in an excessive amount, those excessive hydrogen atoms contribute, in addition to increasing a forbidden band width, to generating turbulences in the structure of a valence electron band, which in turn lead to reducing the positive hole's mobility within the valence electron band.

In addition, along with occurrence of such turbulences in the valence electron band's structure, the density of tail state (which is commonly called as tail state) increases in the side of the valence electron band. The increased tail state functions not only as a trap for positive hole but also as a recombination center and this effects a remarkable negative influence on the transportation of a photoexcited carrier.

In the case of a non-single-crystal silicon carbide film such as a—SiC:H film, there are other inherent difficulties in addition to what above stated. That is, as well known in the field of organic chemistry, there are many hybrid orbitals such as SP, $SP^2$, $SP^3$, etc. for carbon atoms to take when bonded. It is also known that carbon atoms are in the most stable state when they take a graphite structure. In view of this, the quantity of defects in the above non-single-crystal silicon carbide film is influenced by the orbital which is taken by an electron within the carbon atoms.

In this respect, the present inventors have experimentally found that in order to decrease the quantity of defects in the resulting non-single-crystal silicon carbide film, it basically necessitates for the carbon atoms therein to be in a four-coordinate state ($SP^3$).

Further, the binding energy between carbon atom and hydrogen atom is larger than that between silicon atom and hydrogen atom. In this connection, in the case of a non-single-crystal silicon carbide film such as a—SiC:H film, this is a great proportion for hydrogen atoms to remain in a C—H bonded state within the film and because of this, carbon atoms and silicon atoms are often hindered to be bonded among these two kinds of atoms.

On the basis on what above mentioned, the present inventors have made studies on the proportions of each constituent atoms, bonded state of hydrogen atoms and bonded state of carbon atoms for a non-single-crystal silicon carbide film i.e. a—SiC:H film.

As a result, it has been found as for the content of hydrogen atoms to make the resultant a—SiC:H film desirable that it is preferably in the range of from 1 to 10 atomic %, and most preferably in the range of from 3 to 7 atomic %.

The following facts have been also found. That is, in the case where the content of hydrogen atoms is less than 1 atomic %, the number of dangling bonds to which silicon atoms and carbon atoms being related increases to result in making the resulting a—SiC:H film accompanied with defects in a large quantity. And in the case where the content of hydrogen atoms exceeds 10 atomic %, not only defects in the side of a valence electron band but also the proportion of hydrogen atoms to be bonded to carbon atoms undesirably increase and because of this, desirable three-dimensional network is hardly formed. As a result, it is difficult to form a desirable a—SiC:H film.

The present inventors have experimentally found further facts. That is, as for the hydrogen atom in a bonded state to silicon atom in a a—SiC:H film, a so-called Si—H bond wherein one hydrogen atom being bonded to silicon atom is desired. Likewise, as for the carbon atom in a bonded state to hydrogen atom, a so-called C—H bond in which one hydrogen atom being bonded to carbon atom is desired. And, it is necessary for a a—SiC:H film to be a desirable one that it has an intensity ratio of 0.01 to 0.05 between the C—H bond stretching mode and the Si—H bond stretching mode in an infrared absorption spectrum. As long as the above conditions are satisfied, it is possible to make the resulting a—SiC:H film such that dangling bonds are sufficiently compensated with hydrogen atoms and defects relating to hydrogen atoms are negligible.

In addition to the above, the present inventors experimentally found that the carbon content in the film is an important factor in order to attain the object of the present invention. On the basis on this finding and also on the foregoing knowledge that carbon atom may take a great many electron orbits and because of this, defects are easily formed within a a—SiC:H film. The present inventors have made extensive studies on the desirable situation for carbon atoms to be contained in the film. As a result, the present inventors have found a fact that in the case where carbon atoms are contained in a state that they are uniformly dispersed among silicon atoms without contact among themselves, the resulting a—SiC:H film becomes desirable.

As for the carbon content in a a—SiC:H film, in Introduction to Percolation Theory by D. Stauffer, published by Tailor and Francis Inc., 1985, there is stated that there is a space for a a—SiC:H film to be improved as long as it contains about 40 atomic % of carbon atoms.

However, the results obtained as a result of conducting experimental studies by the present inventors about this have shown that there are present clusters comprising carbon atoms in such a—SiC:H film containing about 40 atomic % of carbon atoms and said a—SiC:H film does not exhibit electric characteristics as desired in the present invention. And as a result of further experimental studies by the present inventors, it has been found that the optimum content of carbon atoms which makes the resulting a—SiC:H film to desirably satisfy the conditions in order to attain the object of the present invention is in the range of from 5 to 15 atomic %. Along with this finding, the present inventors have also found a fact that in order desired, it is necessary to make the content of graphite structural domains to be in a proportion of 1% or less per unit volume.

The present inventors have found the following facts in this respect. That is, in the case where the proportion of graphite structural domains per unit volume exceeds 1%, the resulting a—SiC:H film becomes such that has an undesirably low dark resistance and an electrophotographic image-forming member having a photoconductive layer formed of such a—SiC:H film is apt to bring about a reduction in the charge retentivity. Further in this case, the graphite structural domains are likely to become defects, and once this happens, photoexcited carriers become hardly transported, whereby the photosensitivity of the electrophotographic image-forming member becomes inferior.

On the basis of the foregoing findings, the present inventors have reached a conclusion that the non-single-crystal silicon carbide film to effectively attain the object of the present invention is: a non-single-crystal silicon carbide containing hydrogen atoms in an amount of 1 to 10 atomic % and carbon atoms in an amount of 5 to 15 atomic %, containing graphite structural domains in a proportion of 1% or less per unit volume and having an intensity ratio of 0.01 to 0.05 between the C—H bond stretching mode and the Si—H bond stretching mode in an infrared absorption spectrum.

Thus, the photoconductive layer 102 in the electrophotographic image-forming member according to the present invention is formed of the aforesaid non-single-crystal silicon carbide film.

It is possible for the photoconductive layer 102 to be doped with a dopant of p-type or n-type in case where necessary.

For instance, when the photoconductive layer is desired to be of p-conduction type, atoms of an element belonging to the group III of the Periodic Table are incorporated into the foregoing non-single-crystal silicon carbide film. Likewise, when the photoconductive layer is desired to be of n-conduction type, atoms of an element belonging to the group V of the Periodic Table are incorporated into the foregoing non-single-crystal silicon carbide film.

Examples of such element belonging to the group III can include, for example, B, Al, Ga, In and Tl. Examples of such element belonging to the group V can include, for example, P, As, Sb and Bi. Among these elements, B, Ga, P and As are particularly preferred.

The amount of either the group III element or the group V element to be incorporated into the photoconductive layer is preferably in the range of from $1\times10^{-2}$ to $10^2$ atomic ppm, and most preferably in the range of from $1\times10^{-1}$ to 10 atomic ppm, respectively as an effective amount.

The term "effective amount" in this case means a proportion for the element to act as a donor or an acceptor. Therefore, in the case where an donor and an acceptor are incorporated into the photoconductive layer, the quantitative difference between the incorporated amount of the donor and that of the acceptor corresponds an effective doping amount.

As described above, it is possible to make the photoconductive layer to be of a single conduction type by uniformly incorporating either the group III element or the group V element thereinto.

In alternative, it is possible to make the photoconductive layer to have a p-n junction or a p-i-n junctions by switching the kind of a doping element incorporated into the photoconductive layer during its formation.

For the photoconductive layer 102 in the electrophotographic image-forming member of the present invention, it is possible to incorporate one or more kinds of atoms selected from the group consisting of oxygen atoms (O) and nitrogen atoms (N) thereinto aiming at controlling the light absorption characteristics or/and the resistance value thereof. Likewise, it is also possible to incorporate one kind of halogen atoms selected from the group consisting of fluorine atoms (F) and chlorine atoms (Cl) aiming at further improving the defect density.

The photoconductive layer 102 according to the present invention can be disposed directly on the substrate 101 as shown in FIG. 1(A) to thereby obtain a practically applicable electrophotographic image-forming member.

Other than this, the electrophotographic image-forming member of the present invention may take any of the configurations shown in FIGS. 1(B) to 1(D) in which a light receiving layer is of multilayered structure comprising the foregoing photoconductive layer and other one or more layers.

In any case, the thickness of the photoconductive layer 102 is an important factor in order to attain the object of the present invention. The thickness of the photoconductive layer is, therefore, necessary to be carefully determined having due regards so that the resulting electrophotographic image-forming member becomes accompanied with the desired characteristics.

In view of this, the thickness of the photoconductive layer 102 is preferably 5 to 100 μm.

Charge Injection Inhibition Layer 103

In the electrophotographic image-forming member according to the present invention, it is possible to interpose a charge injection inhibition layer 103 between the substrate 101 and the photoconductive layer 102 as shown in FIG. 1(B) or FIG. 1(D) in order to prevent a charge from injecting into the photoconductive layer 102 from the side of the substrate 101 whereby the electrophotographic characteristics are further improved.

Such charge injection inhibition layer may be formed of a non-single-crystal silicon-containing film such as amorphous silicon-containing film, a non-single-crystal silicon oxide film, a non-single-crystal silicon nitride film or a non-single-crystal silicon carbide film respectively being doped with a valence electron controlling element.

In a preferred embodiment, the charge injection inhibition layer 103 is formed of a non-single-crystal silicon carbide film containing hydrogen atoms in an amount of 1 to 10 atomic %, carbon atoms in an amount of 5 to 15 atomic %, and atoms of an element capable of controlling valence electron, containing graphite structural domains in a proportion of 1% or less per unit volume and having an intensity ratio of 0.01 to 0.05 between the C—H bond stretching mode and the Si—H bond stretching mode in an infrared absorption spectrum.

In the above case, the charge injection inhibition layer is considered to exhibit the following effects.

That is, since there is a slight defect in both the foregoing non-single-crystal silicon carbide film to constitute the photoconductive layer 102 and the foregoing non-single-crystal silicon carbide film containing a valence electron controlling element to constitute the charge injection inhibition layer 103, the injection of a charge from the side of the substrate 101 through the defect level is extremely small, the charging characteristics are significantly improved.

In the case where an electrophotographic image-forming member is used in a high-speed electrophotographic copying system where the corona charging quantity is heightened: and said electrophotographic image-forming member is an electrophotographic image-forming member having a charge injection inhibition layer formed of a known amorphous silicon carbide film containing a valence electron controlling element and a photoconductive layer formed of a known amorphous silicon carbide film, the injection of a charge through the defect level is significantly great and those charges as injected are accelerated with the action of the electric field by the corona charging to thereby receive an excessive energy. These injected charges having an excessive energy are mutually contacted with the defects or/and the lattices in the film to excite the charges as trapped within said defects whereby charges within the band being avalanche like are increased. As a result, excess electric current runs in the photoconductive layer to thereby cause local pinholes on the electrophotographic image-forming member.

On the other hand, in the case of the electrophotographic image-forming member according to the present invention, there is a slight occasion where such pinholes are caused because it is accompanied with a slight defect even when it is used in such high-speed electrophotographic copying system as above mentioned.

Additionally saying, the foregoing specific non-single-crystal silicon carbide film to constitute the photoconductive layer 102 and optionally the charge injection inhibition layer 103 in the electrophotographic image-forming member of the present invention is one that has a slight defect and wherein silicon atoms and carbon atoms being strongly bonded and because of this, a pinhole is hardly caused.

As well as the photoconductive layer 102, the charge injection inhibition layer 103 may be controlled to be of p-conduction type or n-conduction type by incorporating atoms of the group III element or atoms of the group V element thereinto.

Examples of the group III element capable of controlling the conduction of the charge injection inhibition layer to be p-type can include, for example, B, Al, Ga, In and Tl. Likewise, examples of the group V element capable of controlling the conduction of the charge injection inhibition layer to be n-type can include, for example, P, As, Sb and Bi. Among these elements, B, Ga, P and As are particularly preferred.

The amount of either the group III element or the group V element to be incorporated into the charge injection inhibition layer is preferably in the range of from $2\times10^2$ to $1\times10^4$ atomic ppm, and most preferably in the range of from $3\times10^2$ to $5\times10^3$ atomic ppm, respectively as an effective amount.

The situation of said effective amount is of the same meaning as in the case of the foregoing photoconductive layer.

The charge injection inhibition layer 103 may contain one kind of halogen atoms selected from the group consisting of fluorine atoms (F) and chlorine atoms (Cl) aiming at reducing the defect density of the film and also improving the stability of the film in the case where it comprises the foregoing specific non-single-crystal silicon carbide film. In the case where the charge injection inhibition layer 103 comprises one of the foregoing films excluding the said specific non-single-crystal silicon carbide film, it may contain hydrogen atoms (H) and/or one kind of halogen atoms selected from the group consisting of fluorine atoms (F) and chlorine atoms (Cl).

In any of these cases, the amount of said halogen atoms to be incorporated into the charge injection inhibition layer is preferably in the range of from 10 atomic ppm to 5 atomic %. In the case where hydrogen atoms (H) are incorporated, its amount is preferably in the range of from 1 to 40 atomic %.

Every constituent atoms for the charge injection inhibition layer i.e. silicon atoms (Si), carbon atoms (C), oxygen atoms (O), nitrogen atoms (N), hydrogen atoms (H), atoms of the group III, atoms of the group V, fluorine atoms (F), chlorine atoms (Cl) are basically contained uniformly therein respectively with an uniform concentration. However, it is possible for certain atoms to be graded with their concentration with the layer region so that a predetermined concentration distribution may be ensured.

A preferred embodiment for the electrophotographic image-forming member having the photoconductive layer 102 and the charge injection inhibition layer 103 is of the configuration as shown in FIG. 1(B) or FIG. 1(D).

In alternative, it is possible to interpose between the substrate 101 and the charge injection inhibition layer 103 an appropriate layer capable of securing the adhesion between the charge injection inhibition layer 103 and the substrate 101 or a long wavelength light absorption layer in case where necessary.

As for the thickness of the charge injection inhibition layer 103, it should be properly determined with due regards to the interrelation with the thickness of the photoconductive layer 102 and other related factors.

However, in general, it is preferably in the range of from 1000Å to 10 μm.

Surface Layer 104

In the electrophotographic image-forming member according to the present invention, it is possible to dispose a surface layer 104 on the photoconductive layer 102 as shown in FIG. 1(C) or FIG. 1(D), aiming at preventing a charge from injecting into the photoconductive layer from its free surface side and also protecting the photoconductive layer from being mechanically or/and chemically damaged.

The surface layer 104 may be formed of an appropriate translucent film not substantially having a photoconductivity such as a non-single-crystal silicon oxide film, a non-single-crystal silicon nitride film or a non-single-crystal silicon carbide film containing carbon atoms in a relatively large amount.

In a preferred embodiment, the surface layer 104 is formed of a non-single-crystal silicon carbide film containing silicon atoms as a matrix, carbon atoms in an amount of 20 to 40 atomic % and hydrogen atoms in an amount of 50 to 70 atomic % and containing graphite structure domains in a proportion of 1% or less per unit volume.

The surface layer 104 according to the preferred embodiment according to the present invention is considered to exhibit the following effects.

Firstly, in the case of an electrophotographic image-forming member having a surface layer formed of a known translucent amorphous silicon carbide film not substantially having a photoconductivity being laminated on a photoconductive layer formed of a known amorphous silicon carbide film which is different from the above translucent amorphous silicon carbide film, there is often found an phenomenon commonly called "a decrease in the initial surface electric potential" caused by the defects near the free surface of the photoconductive layer, and also the defects of the surface layer. Occurrence of this phenomenon is considered to be caused by a phenomenon wherein charges are trapped near the interface between the photoconductive layer and the surface layer, and the charges thus trapped modify the distribution of an electric field near the said interface to promote the injection of a charge into the photoconductive layer from the side of the free surface of the surface layer.

And the phenomenon of inviting a decrease in the surface initial electric potential is considered to be related to the deep state within the forbidden band present in the known amorphous silicon carbide film.

The foregoing phenomenon of inviting a decrease in the surface initial electric potential is not problematic in the case where such electrophotographic image-forming member is used in an ordinary-speed electrophotographic copying system but remarkably problematic in the case where such electrophotographic image-forming member is used in a high-speed electrophotographic image-forming member wherein negative influences caused by the said phenomenon significantly appear.

On the other hand, in the case of the electrophotographic image-forming member according to the present invention, any such phenomenon of inviting a decrease in the surface initial electric potential as found in the prior art is not observed and a desirable charge retentivity is effectively exhibited even in the case where it is used in a high-speed electrophotographic copying system because both the foregoing specific non-single-crystal silicon carbide film to constitute the photoconductive layer 102 and the foregoing specific non-single-crystal silicon carbide film to constitute the surface layer 104 are respectively accompanied with a slight defect.

In addition, since the surface layer 104 is formed of a non-single-crystal silicon carbide film containing silicon atoms as a matrix, carbon atoms in an amount of 20 to 40 atomic % and hydrogen atoms in an amount of 50 to 70 atomic % and containing graphite structure domains in a proportion of 1% or less per unit volume, it has a desirable structural relaxation and it has a slight defect because of hydrogen atoms being sufficiently bonded to carbon atoms within the film. Because of this, for the electrophotographic image-forming member according to the present invention, there is not found any undesirable defect near the interface between the photoconductive layer 102 and the surface layer 104. And it always and stably exhibit excellent electrophotographic characteristics and therefore, it is well suited to be used in a high-speed electrophotographic copying system.

The surface layer 104 may contain one kind of halogen atoms selected from the group consisting of fluorine atoms (F) and chlorine atoms (Cl) aiming at further reducing the defect density and also further improving the film stability in case where necessary.

The amount of such halogen atoms to be incorporated into the surface layer 104 is preferably in the range of from 10 atomic ppm to 5 atomic %.

As for the thickness of the surface layer 104, it should be properly determined with due regards to the interrelation with the thickness of the photoconductive layer 102 and also to other related factors.

However, in general, it is preferably in the range of from 500Å to 10 μm.

Preparation of Layers

The method of forming the light receiving layer of the electrophotographic image-forming member will now be explained.

Figure 6A:
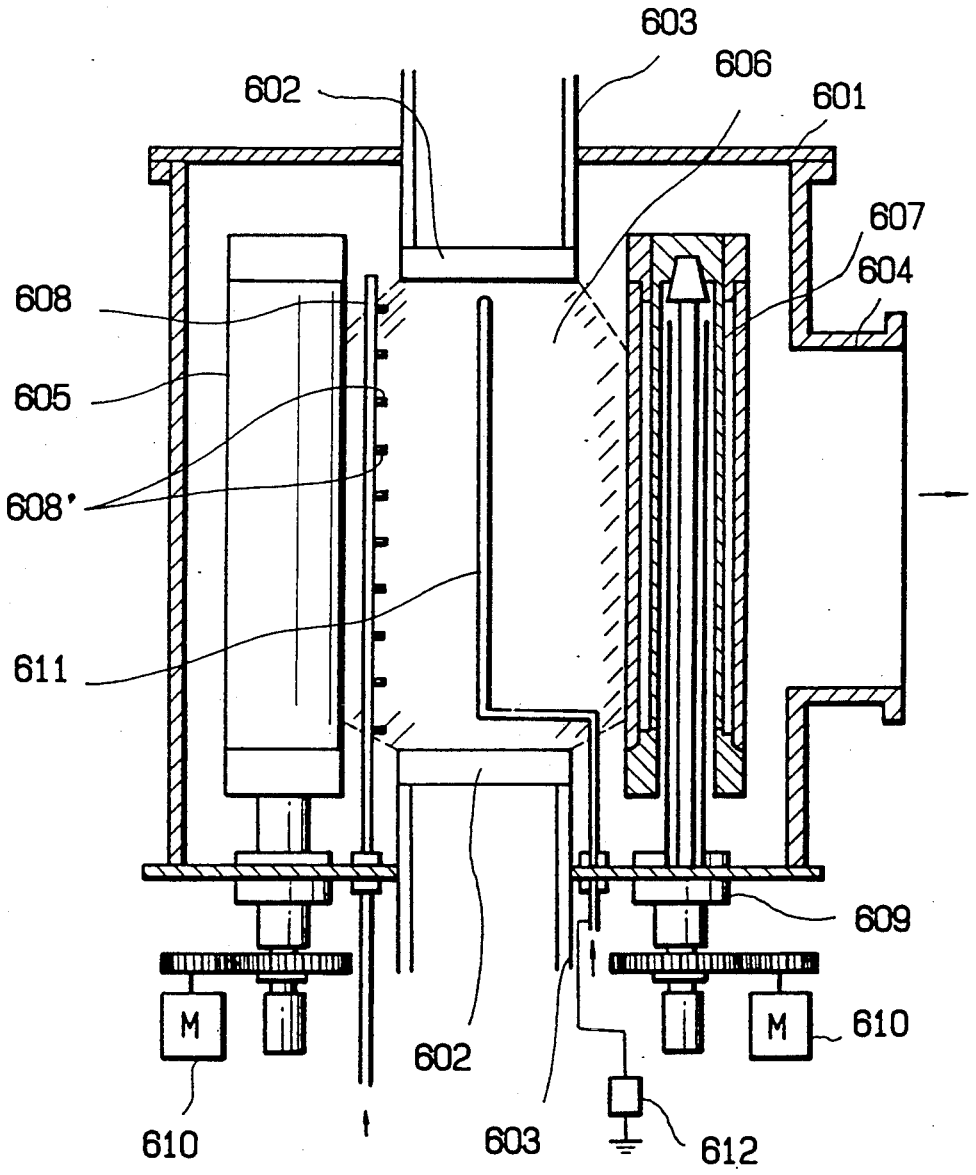
FIG. 6(A) is a schematic longitudinal sectional view, partly broken away, of a microwave plasma chemical vapor deposition apparatus (hereinafter referred to as "MW-PCVD apparatus") which is suitable for preparing a non-single-crystal silicon carbide system electrophotographic image-forming member according to the present invention by way of a microwave plasma chemical vapor deposition process (hereinafter referred to as "MW-PCVD process").
Figure 6B:
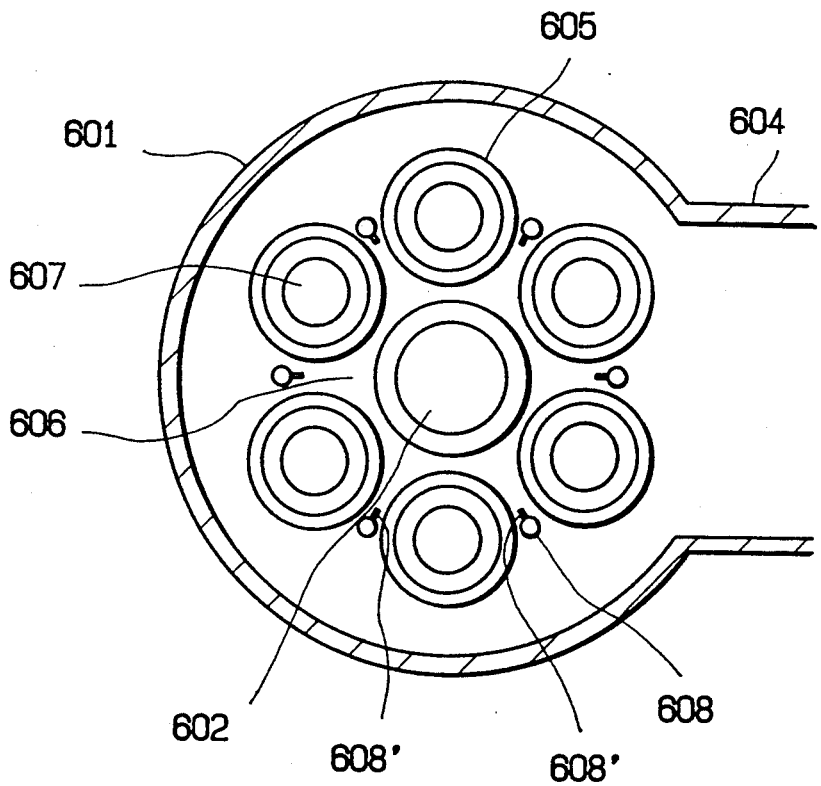
FIG. 6(B) is a schematic partial cross-sectional view of the MW-PCVD apparatus shown in FIG. 6(A).

Each layer to constitute the light receiving layer of the electrophotographic image-forming member according to the present invention can be properly prepared by a microwave plasma chemical vapor deposition method (MW-PCVD method in short) using a MW-PCVD apparatus shown in FIGS. 6(A) and 6(B), wherein relevant film-forming raw material gases are selectively used.

FIG. 6(A) is a schematic longitudinal sectional view, partly broken away, of a MW-PCVD apparatus which is suitable for practicing said MW-PCVD method. FIG. 6(B) is a schematic partial cross-sectional view of the MW-PCVD apparatus shown in FIG. 6(A). The MW-PCVD apparatus shown in FIGS. 6(A) and 6(B) comprises a substantially enclosed cylindrical deposition chamber 601 having discharge space (reaction space) 606. The deposition chamber 601 is provided with a microwave transmissive window 602 made of alumina ceramics, a waveguide 603 for microwave being extended from a microwave power source (not shown), and an exhaust pipe 604 being connected through a main valve (not shown) to an exhaust device such as diffusion pump (not shown). In the deposition chamber 601, there are installed a plurality of rotatable cylindrical substrate holders 607 each having a cylindrical substrate 605 being placed thereon so as to circumscribe the discharge space 606. Each of said plurality cylindrical substrate holders 607 has an electric heater installed therein. Numeral reference 610 stands for a motor to rotate each cylindrical substrate holder 607. Numeral reference 608 stands for a gas feed pipe being longitudinally installed in the discharge space 606, which is extended through mass flow controllers (not shown) from a gas reservoir (not shown). The gas feed pipe 608 has a plurality of gas liberation nozzles 608' capable of supplying a film-forming raw material gas toward the center of the discharge space 606. It is possible to install two or more gas feed pipes 608 in the discharge space 606. In a preferred embodiment in this respect, a gas feed pipe 608 is installed in a space between every two cylindrical substrate holders 607 such that the discharge space 601 is circumscribed by said plurality of cylindrical substrate holders 607 and a plurality of gas feed pipes 608. Numeral reference 611 stands for a feed pipe having a plurality of gas liberation holes (not shown) capable of radiately supplying a film-forming raw material gas in the discharge space 606, which is extended through mass flow controllers (not shown) from a gas reservoir (not shown). The feed pipe 611 is longitudinally installed near or in the center of the discharge space 606. The feed pipe 611 functions not only as a gas feed pipe but also as a bias electrode. Numeral reference 612 stands for a bias power source for applying DC, AC or RF bias onto the feed pipe 611.

Preparation of the Charge Injection Inhibition Lay 103

(1) Preparation of the Charge Injection Inhibition Layer 103 Comprising the Foregoing Specific Non-Single-Crystal Silicon Carbide Film The preparation of the charge injection inhibition layer 103 comprising the foregoing specific non-single-crystal silicon carbide film containing atoms of an element capable of controlling valence electron by means of MW-PCVD process using the MW-PCVD apparatus shown in FIGS. 6(A) and 6(B) is carried out, for example, in the following way.

Firstly, a cylindrical substrate 605 for electrophotography is placed on each cylindrical substrate holder 607 in the deposition chamber 601. Then all the cylindrical substrate holders are made rotating by revolving the motor 610. Thereafter, the inside of the deposition chamber 601 is evacuated by the action of the diffusion pump (not shown) to thereby bring the discharge space 606 to a vacuum of $10^{-6}$ Torr or less.

Then, the electric heater of each cylindrical substrate holder 607 is actuated to heat each cylindrical substrate 605 to a temperature in the range of 200° to 400° C. and all the cylindrical substrates 605 are kept at this temperature.

Successively, a raw material gas for forming the charge injection inhibition layer is supplied into the discharge space 606 at a predetermined flow rate through the gas feed pipe 608 or the feed pipe 611. In a preferred embodiment of this respect, a raw material gas capable of imparting carbon atoms (hereinafter referred to as "carbon atom-imparting gas") is supplied through the gas feed pipe 608, and a raw material gas capable of imparting silicon atoms (hereinafter referred to as "silicon atom-imparting gas"), a raw material gas capable of imparting hydrogen atoms (hereinafter referred to as" hydrogen atom-imparting gas") and a raw material gas capable of imparting atoms of a valence electron controlling element (hereinafter referred to as "valence electron controlling gas") are supplied through the feed pipe 611. As for said carbon atom-imparting gas, it is desired to make said gas contributed to forming a film within a short time as much as possible without it being exposed to plasma for a long period of time because of the following reason. That is, when decomposition of a carbon atom-imparting gas proceeds within plasmas to thereby liberate carbon atoms therein, there is a tendency that such carbon atoms react with the carbon atom-imparting gas as supplied or/and with carbon atoms in the film as deposited to thereby take a graphite structure into the resulting deposited film because such carbon atoms as liberated within plasmas are highly reactive.

In the case of preparing a large device such as an electrophotographic image-forming member wherein the layer thickness is required to be some tens μm, the film formation is necessary to be carried out at a high deposition rate. In this case, it is necessary to impart a sufficient decomposition energy to a silicon atom-imparting gas. Further, in view of making the resulting deposited film not accompanied with a defect and then improving the electric characteristics of the resulting deposited film, it is necessary to use a hydrogen-atom imparting gas. When said hydrogen atoms-imparting gas is in the form of, for example, $H_2$ gas in the reaction space, such hydrogen atom-imparting gas does not sufficiently contribute to improving the electric characteristics of the resulting deposited film as desired, and in the case where hydrogen radicals are formed from said hydrogen atom-imparting gas in the reaction space, those hydrogen radicals become contributing to improve the electric characteristics of the resulting deposited film. Likewise, as for the valence electron controlling gas, in order to effectively utilize said gas, it is necessary to place said gas in a condition to receive a sufficient decomposition energy within plasmas.

These knowledges have been obtained as a result of conducting various experimental studies by the present inventors in order to form a desirable non-single crystal silicon carbide film which is suitable to constitute the charge injection inhibition layer 103 of the electrophotographic image-forming member according to the present invention.

After selected raw material gases being introduced into the discharge space at respective flow rates in the way as above mentioned, the inner pressure of the discharge space is adjusted to a predetermined vacuum of 0.1 Torr or less by regulating the main valve of the exhaust pipe 604. After the respective flow rates of the raw material gases and the vacuum of the discharge space becomes stable, the microwave power source is switched on to thereby introduce microwave energy into the discharge space 606 through the waveguide 603 and the microwave transmissive window 602.

The microwave energy introduced into the discharge space 606 in this case is made 1.1 times or more over that required for the deposition rate to be saturated.

Thus, the respective film-forming raw material gases including hydrogen gas receive sufficient microwave energy and they are decompassed to generate active species capable of causing the formation of a deposited film on each cylindrical substrate 605.

At the time when the film-forming raw material gases are introduced into the discharge space 601 in the above procedures, the bias electric power source 612 is switched on to thereby apply DC bias electric power onto the feed pipe 611. In this case, ions in plasmas as generated in the discharge space 606 are applied with sufficient energy whereby atoms capable of causing the formation of a deposited film are made desirably rearranged on the surface of each cylindrical substrate 605 to cause the formation of the foregoing non-single-crystal silicon carbide film having excellent electric characteristics, which is suitable to constitute the charge injection inhibition layer 103 on each cylindrical substrate 605. In this case, it is required for the feed pipe 611 to be positive. In the case where the feed pipe 611 is made negative, any DC bias effect cannot be obtained.

In the above case, it is possible to apply RF bias electric power in stead of said DC bias electric power. In this case, there can be obtained the same effect as in the case of applying said bias electric power. In the case of applying RF bias electric power of 13.56 MHz, for example, the stability of plasma discharge becomes significantly improved at a vacuum of near $1\times10^{-3}$ Torr.

To apply said DC or RF electric power onto the feed pipe 611 through which a silicon atom-imparting gas being supplied into the discharge space 606 is an important factor for applying sufficient energy on the silicon atom-imparting gas so as to be well decomposed and applying an appropriate quantity of energy on the carbon atom-imparting gas not to be too much decomposed but to be soon served for reaction.

The inner pressure in the discharge space 606 is also an important factor for forming a desired non-single-crystal silicon carbide film according to the present invention. It is preferably $1\times10^{-1}$ Torr or less, and most preferably in the range of from $5\times10^{-4}$ to $1\times10^{-2}$ Torr.

Likewise, the bias electric power to be applied onto the feed pipe 611 is also an important factor. It is preferably controlled to a power of 0.2 to 1.5 times over the microwave power applied into the discharge space 606. More preferably, it is controlled to a power of 0.5 to 1.0 time over the said microwave power.

There cannot be obtained a desirable bias effect in the case where a bias electric power being less than the above lower limit is applied. In the case where a bias electric power being more than the above upper limit is applied, the resulting deposited film becomes accompanied with undesirable defects.

The present inventors have experimentally found that the bias electric power to be applied onto the feed pipe 611 through which a silicon atom-imparting gas being supplied into the discharge space 606 is closely interrelated to the deposition rate, vapor phase reaction within plasmas and surface reaction on the surface of each cylindrical substrate 605 and only in the case where the bias electric power to be applied is in the above range, there can be formed a desirable non-single-crystal silicon carbide film according to the present invention.

The material of which the feed pipe 611 is made is a very important factor in order to obtain a high quality deposited film because it is always exposed to strong plasma. In view of this, it is required for the said material to be of a high melting point, not to be hardly sputtered and not to be reactive with a film-forming raw material gas.

As the material to satisfy all these conditions, there can be mentioned, for example, stainless steels, Ni, Mo, Ta, Pt, etc.

In order to form a desirable non-single-crystal silicon carbide film which can effectively attain the object of the present invention, appropriate raw material gases are selectively used.

Specific examples of the silicon atom-imparting gas can include, for example, silane gases such as $SiH_4$, $Si_2H_6$, $Si_3H_8$, $SiF_4$, $Si_2F_2$, etc.

Specific examples of the carbon atom-imparting gas can include, for example, $CH_4$, $C_2H_6$, $C_3H_8$, $C_2H_4$, $C_3H_6$, $C_2H_2$, $C_6H_6$, $CF_4$, etc. Other than these, there can be used a gaseous silicon and carbon-containing material such as $(CH_3)_4Si$.

As for the quantitative ratio of the above silicon atom-imparting gas to the above carbon atom-imparting gas to be introduced into the discharge space 606, it is preferably in the range of from 10/5 to 100/1, and most preferably, in the range of from 10/2 to 100/5, respectively on the basis of flow rate ratio.

It is possible to mix these gases and to introduce the resultant gaseous mixture into the discharge space 606.

In order to form a high quality non-single-crystal silicon carbide film, it is necessary to use a gaseous mixture comprising a film-forming raw material gas and hydrogen gas in any case.

In order to form a desirable valence electron controlled non-single-crystal silicon carbide film to constitute the charge injection inhibition layer 103 in the electrophotographic image-forming member according to the present invention, the aforesaid non-single-crystal silicon carbide film is doped with atoms of an element belonging to the group III (in the case of making the resulting film to be of p-type) or group V (in the case of making the resulting film to be of n-type) of the Periodic Table during its formation.

As the group III element, there can be mentioned B, Al, Ga, In and Tl. Specific examples of the raw material capable of imparting atoms of such element belonging to the group III are, for example, boron hydrides such as $B_2H_6$, $B_4H_{10}$, $B_5H_9$, $B_5H_{11}$, $B_6H_{10}$, $B_6H_{12}$ and $B_6H_4$, and other than these, $AlCl_3$, $GaCl_3$, $Ga(CH_3)_3$, $InCl_3$, $TlCl_3$, etc.

As the group V element, there can be mentioned P, As, Sb, Bi, etc. Specific examples of the raw material capable of imparting atoms of such element belonging to the group V are, for examples, phosphorus hydrides such as $PH_3$, $P_2H_4$, etc., and other than these, $AsH_3$, $SbH_3$, $BiH_3$, etc.

As previously described, the charge injection inhibition layer 103 may contain one or more kinds of atoms selected from the group consisting of oxygen atoms (0), nitrogen atoms (N), fluorine atoms (F) and chlorine atoms (Cl). In order to incorporate such atoms into the charge injection inhibition layer, at the time of forming the foregoing valence electron controlled non-single-crystal silicon carbide film, a proper raw material gas capable of imparting such atoms is introduced into the discharge space.

As the oxygen atom-imparting gas, there can be mentioned $O_2$, NO, $NO_2$, $N_2O$, etc.

As the nitrogen atom-imparting gas, there can be mentioned $N_2$, $NH_3$, etc.

Specific examples of the fluorine atom-imparting gas are, for example, $SiF_4$, $Si_2F_6$, $F_2$, $CF_4$, HF, etc. Specific examples of the chlorine atom-imparting gas are, for example, HCl, $Cl_2$, $SiCl_4$, etc.

(2) Preparation of the Charge Injection Inhibition Layer 103 Comprising a Non-Single-Crystal Silicon-Containing Film Other than the Foregoing Specific Non-Single-Crystal Silicon Carbide Film As previously described, the charge injection inhibition layer 103 in the electrophotographic image-forming member may be formed of a non-single-crystal silicon-containing film selected from the group consisting of a non-single-crystal silicon film such as an amorphous silicon film, a non-single-crystal silicon oxide film, a non-single-crystal silicon nitride film and a known non-single-crystal silicon carbide film respectively being doped with atoms of a valence electron controlling element.

The formation of the charge injection inhibition layer 103 in this case can be carried out in the manner similar to the above case (1) using the MW-PCVD apparatus shown in FIG. 6(A) and 6(B).

In this case, such strict film-forming conditions as in the above case (1) are not required, and conventional film-forming conditions which are commonly employed in the MW-PCVD process for forming a non-single-crystal silicon-containing film can be selectively employed.

And, as the film-forming raw material gas in the case of forming a non-single-crystal silicon film, there is used $SiH_4$, $Si_2H_6$, $Si_3H_8$, $SiF_4$ or $Si_2F_6$ as the main film-forming raw material gas.

In the case of forming a non-single-crystal silicon oxide film, there is used $O_2$, NO, $N_2O$, CO or $CO_2$ in addition to said silane gas as the main film-forming raw material gases.

In the case of forming a non-single-crystal silicon nitride film, there is used $N_2$ or $NH_3$ in addition to the above silane gas as the main film-forming raw material gases.

Likewise, in the case of forming a non-single-crystal silicon $C_3H_6$, $C_2H_2$ or $C_6H_6$ in addition to the above silane gas as the main film-forming raw material gases.

In order to make such non-single-crystal silicon-containing film suitable to constitute the charge injection inhibition layer 103, such non-single-crystal silicon-containing film is doped with atoms of a proper valence electron controlling element belonging to the group III or the group V of the Periodic Table to be p-type or n-type by introducing a proper group III or group V element imparting gas selected from those mentioned in the above case (1) into the discharge space 606 either alone or together with the film-forming raw material gas during the film-forming process.

The charge injection inhibition layer 103 in this case may be contain one or more kinds of atoms selected from the group consisting hydrogen atoms (H) and halogen atoms (X) i.e. fluorine atoms (F) and chlorine atoms (Cl).

The incorporation of hydrogen atoms thereinto can be carried out by introducing hydrogen gas ($H_2$) into the discharge space 606 either alone or together with the film-forming raw material gas during the film-forming process.

The incorporation of halogen atoms (X) thereinto can be carried out by introducing a proper halogen atoms (X)-imparting gas selected from those mentioned in the above case (1) into the discharge space 606 either alone or together with the film-forming raw material gas during film-forming process.

Preparation of the Photoconductive Layer 102

As previously described, the photoconductive layer 102 in the electrophotographic image-forming member according to the present invention comprises the foregoing specific non-single-crystal silicon carbide film.

The photoconductive layer 102 may be properly formed by repeating the same procedures for forming the non-doped specific non-single-crystal silicon carbide film as detailed in the foregoing preparation case (1) for the charge injection inhibition layer 103.

The photoconductive layer 103 in the electrophotographic image-forming member according to the present invention may be p-conduction or n-conduction type.

In order to make the photoconductive layer to be of p-conduction type or n-conduction type, the foregoing specific non-single-crystal silicon carbide film is doped with atoms of an element belonging to the group III of the Periodic Table or atoms of an element belonging to the group V of the Periodic Table in the same manner as in the case of forming a p-type charge injection inhibition layer or an n-type charge injection inhibition layer in the foregoing preparation case (1) for the charge injection inhibition layer 103.

As well as in the case of the charge injection inhibition layer 103, the photoconductive layer 102 may contain one or more kinds of atoms selected from the group consisting of oxygen atoms (0), nitrogen atoms (N), fluorine atoms (F) and chlorine atoms (Cl) in case where necessary.

The incorporation of such atoms into the photoconductive layer 102 can be carried out by repeating the same procedures in this respect in the foregoing preparation case (1) for the charge injection inhibition layer.

Preparation of the Surface Layer 104

As previously described, in a preferred embodiment of the electrophotographic image-forming member of the present invention, the surface layer 104 is desired to be constituted by a non-single-crystal silicon carbide film containing silicon atoms as a matrix, carbon atoms in an amount of 20 to 40 atomic % and hydrogen atoms in an amount of 50 to 70 atomic % and containing graphite structure domains in a proportion of 1% or less per unit volume.

In this case, the surface layer 104 may be properly formed by repeating the procedures for forming the non-doped specific non-single-crystal silicon carbide film as detailed in the foregoing preparation case (1) for the charge injection inhibition layer 103, except that the flow rate of a carbon atom-imparting gas is made relatively higher than that of a silicon atom-imparting gas such that the content carbon atoms contained in the resulting film is made to be in the range of from 20 to 40 atomic %, the substrate temperature is controlled to be in the range of from 20° to 150° C., and the flow rate of hydrogen gas is regulated such that the content of hydrogen atoms in the resulting film is made to be in the range of 50 to 70 atomic %.

Further, in alternative, as previously described, the surface layer 104 may be formed of an appropriate translucent film not substantially having a photoconductivity such as a non-single-crystal silicon oxide film, a non-single-crystal silicon nitride film or a non-single-crystal silicon carbide film containing carbon atoms in a relatively large amount.

In this case, any of such translucent films to constitute the surface layer 104 may be properly formed in accordance with the procedures described in the foregoing preparation case (2) for the charge injection inhibition layer.

DESCRIPTION OF THE PREFERRED EMBODIMENTS

This invention will be described more specifically while referring to Examples, but the invention is not intended to limit the scope only to these examples.

EXAMPLE 1 AND COMPARATIVE EXAMPLE 1

The foregoing procedures for practicing the MW-PCVD process using the MW-PCVD apparatus shown in FIGS. 6(A) and 6(B) were conducted under the film-forming conditions shown in Table 1 in which the mark A means the film-forming conditions other than the present invention and the mark B means the film-forming conditions of the present invention, to thereby prepare 14 non-single-crystal silicon carbide film sample groups (Samples Nos. 001 to 0014), each sample group containing 6 non-single-crystal silicon carbide film samples.

In each sample group, there were placed a pair comprising a glass plate and a Si-wafer plate respectively of 1 inch×2 inch in size in the respective channels formed at the upper part of each of 6 cylindrical aluminum substrates 605 respectively of 108 mm in outer diameter, 360 mm in length and 5 mm in thickness in the deposition chamber 601. And a non-single-crystal silicon carbide film was formed on each of those glass plates and Si-wafer places. As the said glass plate, there was used a Corning's No. 7059 glass plate (product of Corning Glass Works, U.S.A.).

For the thus obtained samples, there were observed the film composition and the film structure. And there was also observed the film quality.

The observed results obtained were collectively shown in Table 2. The values obtained through measurements shown in Table 2 are average values among the six samples.

(i) The determination of the hydrogen content in the film sample was conducted in accordance with a conventional method using FTIR (Nicolet 60 SXB) on the resultant film formed on the Si-wafer plate.

(ii) The determination of the IR intensity ratio for the film was conducted in accordance with a conventional method using FTIR (Nicolet 60 SXB) on the resultant film formed on the Si-wafer plate.

(iii) The determination of the carbon content in the film was conducted on the resultant film formed on the glass plate using XMA (product of Hitachi Seisakujo K.K.: X-650).

(iv) The determination of the graphite domain's content proportion in the film was carried out in the following.

Firstly, the Si-wafer plate having the resultant film thereon was set to Laser Raman Spectrophotometer (product of Japan Spectroscopic Co., Ltd.: NR-1100) to thereby measure a Raman spectrum therefor.

Then, the proportion (%) for graphite structural domains per unit volume in the film was obtained by making the peak area between 480 $cm^{-1}$ and 520 $cm^{-1}$ relating to the transverse optical mode of silicon atom to be 100 % as a control and comparing the total area of all the peaks appeared between 1450 $cm^{-1}$ and 1710 $cm^{-1}$ relating to graphite with the said control.

(v) In the evaluation of the resultant film in the viewpoint of film quality, a tail state for the resultant film formed on the glass plate was measured in accordance with a conventional photothermal deflection spectroscopy (see, Semiconductors and Semimetals Vol. 21, p. 83, 1984, Academic Press, Inc.).

The measured extinction coefficient can be expressed by the following equation with respect to Urbach tail:

$$\alpha = \alpha_o \exp\left(-\frac{h_\nu}{Ec}\right)$$

where $\alpha$ is an extinction coefficient, $\alpha_o$ is a constant, $h_\nu$ is energy irradiated and Ec is characteristic energy. As for the broadening of a tail state, the fewer, the smaller the characteristic energy (Ec) is. That is, it can be said that the better the film quality is, the smaller the characteristic energy (Ec) is.

The sample's identification numbers in Table 2 are corresponding those in Table 1.

From the results shown in Table 2, it has been recognized that any of the resultant films of Sample Nos. 011, 012, 013 and 014 is corresponding the specific non-single-crystal silicon carbide film according to the present invention, that is, a non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum. It has been also recognized that any of the above four films has a characteristic energy (Ec) being lower that for any of the remaining comparative films and which excels in film quality.

COMPARATIVE EXAMPLE 2

Figure 7:
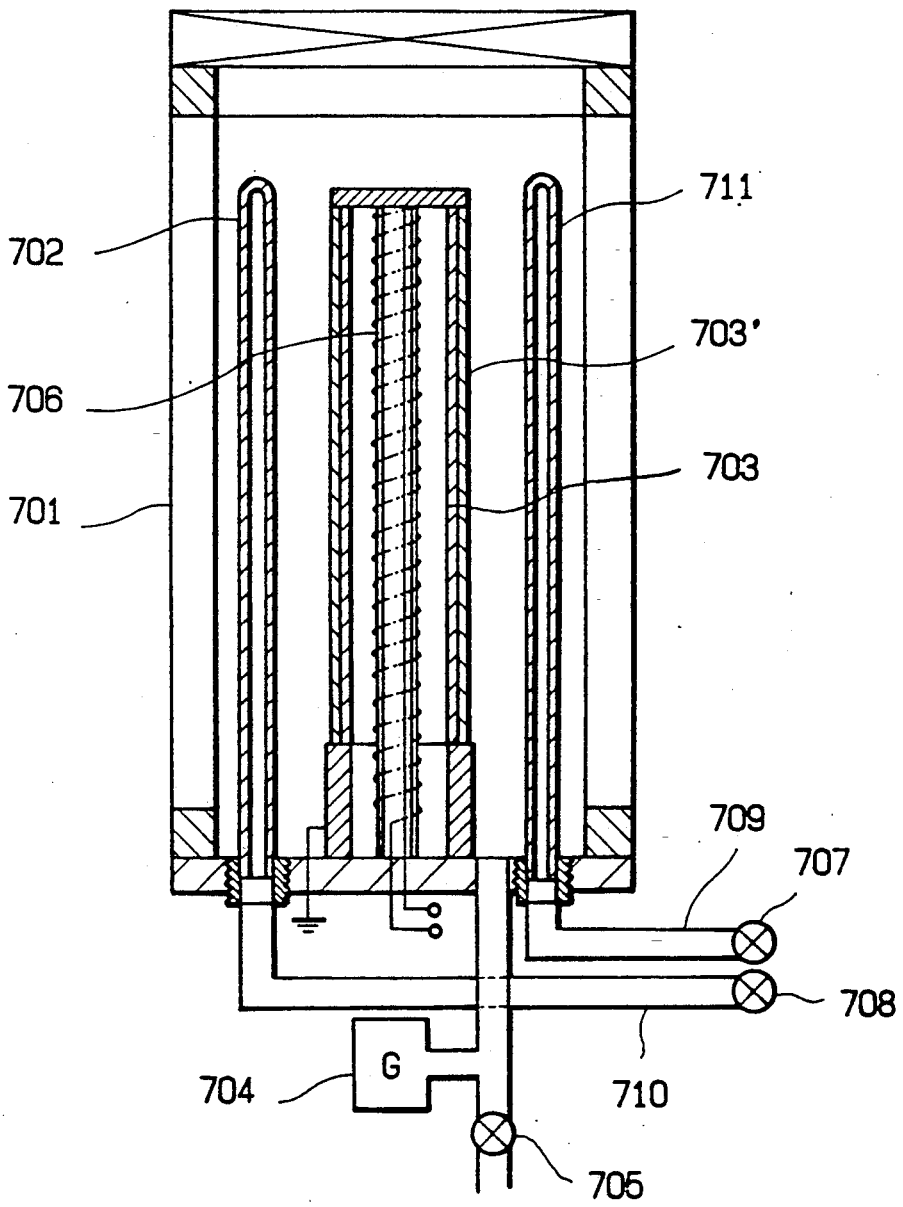
FIG. 7 is a schematic longitudinal sectional view, partly broken away, of an apparatus for preparing an amorphous silicon carbide system electrophotographic image-forming member by way of a RF-glow discharge decomposition process in the later described comparative examples.

In this comparative example, in accordance with an RF (13.56 MHz)-glow discharge decomposition method using the film-forming apparatus shown in FIG. 7 which is suitable for practicing said RF-glow discharge decomposition method, there was formed a film on a Corning's No. 7059 glass plate and also on a Si-wafer plate respectively of 1 inch×2 inch in size being placed in the respective channels formed at the upper part of a cylindrical aluminum sample holder of 108 mm in outer diameter, 360 mm in length and 5 mm in thickness being placed on a cylindrical substrate holder 703 in a deposition chamber 701 under the film-forming conditions for Sample No. 015 shown in Table 3.

The film-forming process was carried out in the way as hereunder mentioned.

Firstly, the foregoing cylindrical aluminum sample holder 703' having said glass plate and said Si-wafer plate arranged thereon was placed on the substrate holder 703. Then, an exhaust valve 705 was opened and the deposition space of the deposition chamber 701 was evacuated by operating a vacuum pump (not shown).

Upon the reading of a vacuum gauge 704 having become about $1\times10^{-3}$ Torr, $SiH_4$ gas and $H_2$ gas were introduced through a plurality of gas liberation holes (not shown) provided with a gas feed pipe 711 extending from a conduit 709 being connected through a feed valve 707 to gas reservoirs (not shown) at the respective flow rates of 1000 sccm and 5000 sccm into the deposition space of the deposition chamber 701. At the same time, $C_2H_2$ gas was introduced through a plurality of gas liberation holes (not shown) provided with a feed pipe $7O_2$extending from a conduit 710 being connected through a feed valve 708 to a gas reservoir (not shown) at a flow rate of 100 sccm into the deposition space of the deposition chamber 701.

The temperature of the cylindrical aluminum sample holder 703 was controlled by means of an electric heater 706.

After the preliminary arrangements being thus completed, a RF-power source (not shown) was switched on to thereby apply a RF power into the deposition space of the deposition chamber 701. Thus, there was formed a deposited film on each of the glass plate and the Si-wafer plate.

The films thus obtained were evaluated in the same way as in Example 1.

The evaluated results obtained were as shown in Table 4. As Table 4 illustrates, it is understood that in the case of forming a non-single-crystal silicon carbide film in accordance with the RF-glow discharge decomposition method, the amount of hydrogen atoms to be taken into the resulting film becomes increased and the proportion of graphite domains formed in the resulting film becomes great.

EXAMPLE 2 AND COMPARATIVE EXAMPLE 3

In Example 2, there were prepared a plurality of electrophotographic image-forming members having the configuration shown in FIG. 1(A) by repeating the same film-forming procedures as employed in Example 1, except that neither the glass plate nor the Si-wafer plate were used but a cylindrical aluminum substrate 101 of 108 mm in outer diameter, 360 mm in length and 5 mm in thickness was used, under each of the film-forming conditions employed for Sample Nos. 011 to 014 shown in Table 1.

Likewise, in Comparative Example 3, there were prepared a plurality of electrophotographic image-forming members having the configuration shown in FIG. 1(A) by repeating the same film-forming procedures as employed in Comparative Example 1, except that neither the glass plate nor the Si-wafer plate were used but a cylindrical aluminum substrate 101 of 108 mm in outer diameter, 60 mm in length and 5 mm in thickness, under each of the film-forming conditions for Samples Nos. 001 to 010 shown in Table 1 and the film-forming conditions for Sample No. 115 shown in Table 3.

As for the thickness of the photoconductive layer 102, it was made 25 μm in every case. For each of the thus obtained electrophotographic image-forming member samples, there were evaluated its electrophotographic characteristics using a conventional high-speed electrophotographic copying machine (product of Canon K.K.: NP 8570). For use in this case, said electrophotographic copying machine was so modified that all of the charge retentivity, dark decay, photosensitivity, and ghost appearance can be evaluated and the process speed of 90 copies/minute (A-4 size) can be attained.

That is, each of the resultant samples was set to this modified high-speed electrophotographic copying machine to evaluate charge retentivity, dark decay, photosensitivity and ghost appearance wherein light of 700 nm in wavelength was irradiated with 20 erg in pre-exposure.

Figure 8A:
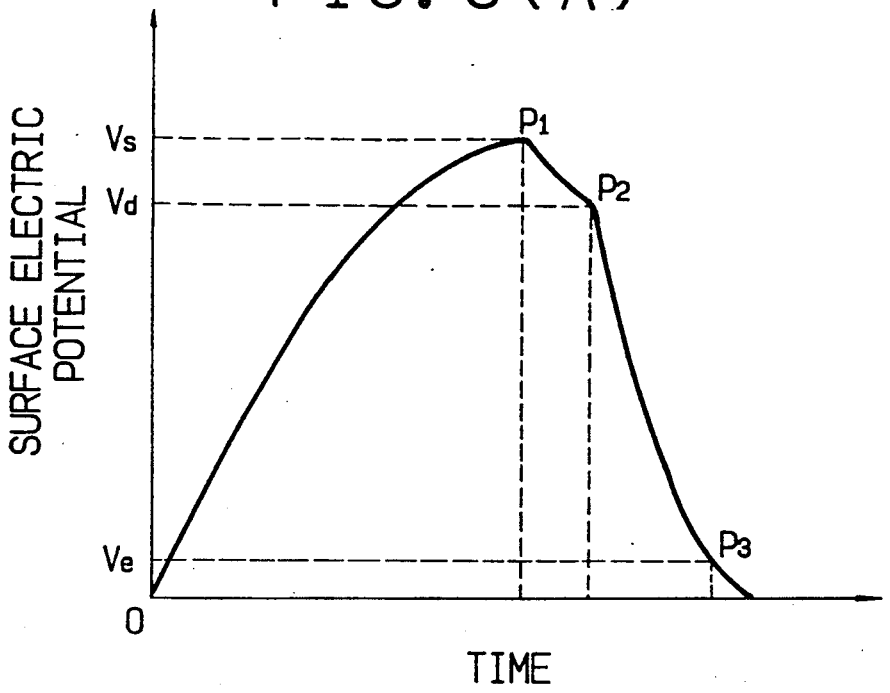
FIGS. 8(A) and 8(B) are schematic explanatory views of a method for evaluating the resultant image-forming members in the later described examples and comparative examples.

Firstly, as a result of examining the surface electric potential on an electrophotographic image-forming member according to the present invention, there was obtained a typical curve changing with the passage of time in the electrophotographic image-forming process as shown in FIG. 8(A).

Explaining about what shown in FIG. 8(A), it is understood from the curve shown in FIG. 8(A) that the surface electric potential of the electrophotographic image-forming member is changed upon corona charge and light exposure. That is, the surface electric potential increases from the position "O" to the position "$P_1$" where it becomes the value of Vs with corona charge. Thereafter the electrophotographic image-forming member moves to exposure zone ($P_2$). During this period of time, the surface electric potential becomes the value of Vd because of dark decay. At the exposure zone ($P_2$), the said member receives image exposure, and then the surface electric "$P_3$".

In this connection, the charge retentivity was evaluated by Vd in corona current. The dark decay was evaluated by a value obtained by the equation: $Vs-Vd$ where the Vd is made constant. The photosensitivity was evaluated by the quantity of exposure light (wavelength: 500 nm) required to obtain a surface electric potential Ve corresponding to 10% of Vd where the Vd is made constant.

Further as for the ghost appearance, it was evaluated in the following way.

Figure 8B:
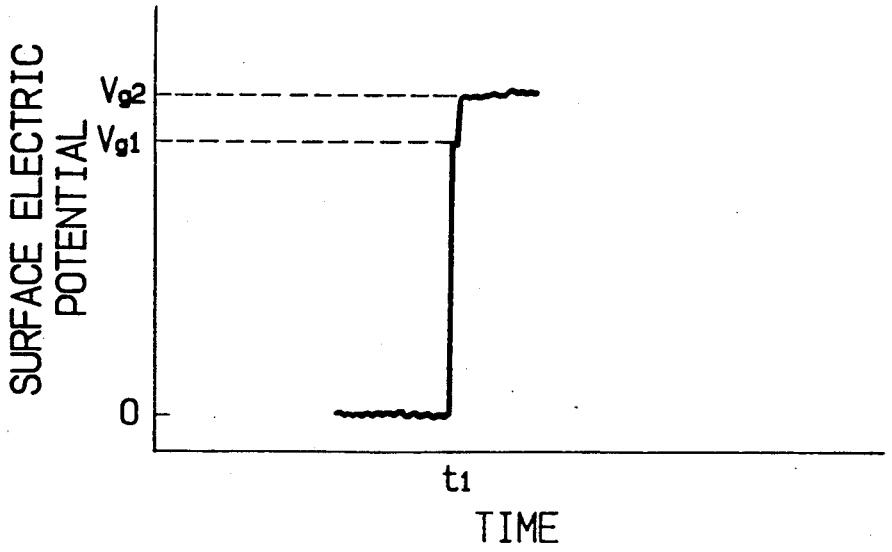

In FIG. 8(B), there is shown a typical graph concerning changes in the surface electric potential obtained by subjecting an electrophotographic image-forming member according to the present invention step-functionally to corona charge. Explanation is to be made about the graph shown in FIG. 8(B). In the electrophotographic image-forming process, the electrophotographic image-forming member is rotated under charging unit sometimes and because of this, the said member receives repeated charging accordingly. In this respect, in the graph shown in FIG. 8(B), there are shown a surface electric potential Vg at the first charging and another surface electric potential $Vg_2$ at the second discharging. In view of this, the ghost appearance was evaluated with a value obtained by the equation: $Vg_2-Vg_1$.

The results thus obtained are collectively shown in Table 5. All the values shown therein are relative ones. From what shown in Table 5, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 111, 112, 113 and 114 belonging to the present invention are surpassing the remaining comparative electrophotographic image-forming member samples in any of the above evaluation items and they are particularly suited for use in a high-speed electrophotographic copying system.

EXAMPLE 3

Sample No. 111 obtained in Example 2 was subjected to positive corona charge and negative corona charge. In each case, there was measured optical attenuation for the surface electric potential wherein the light wavelength is changed.

Figure 9:
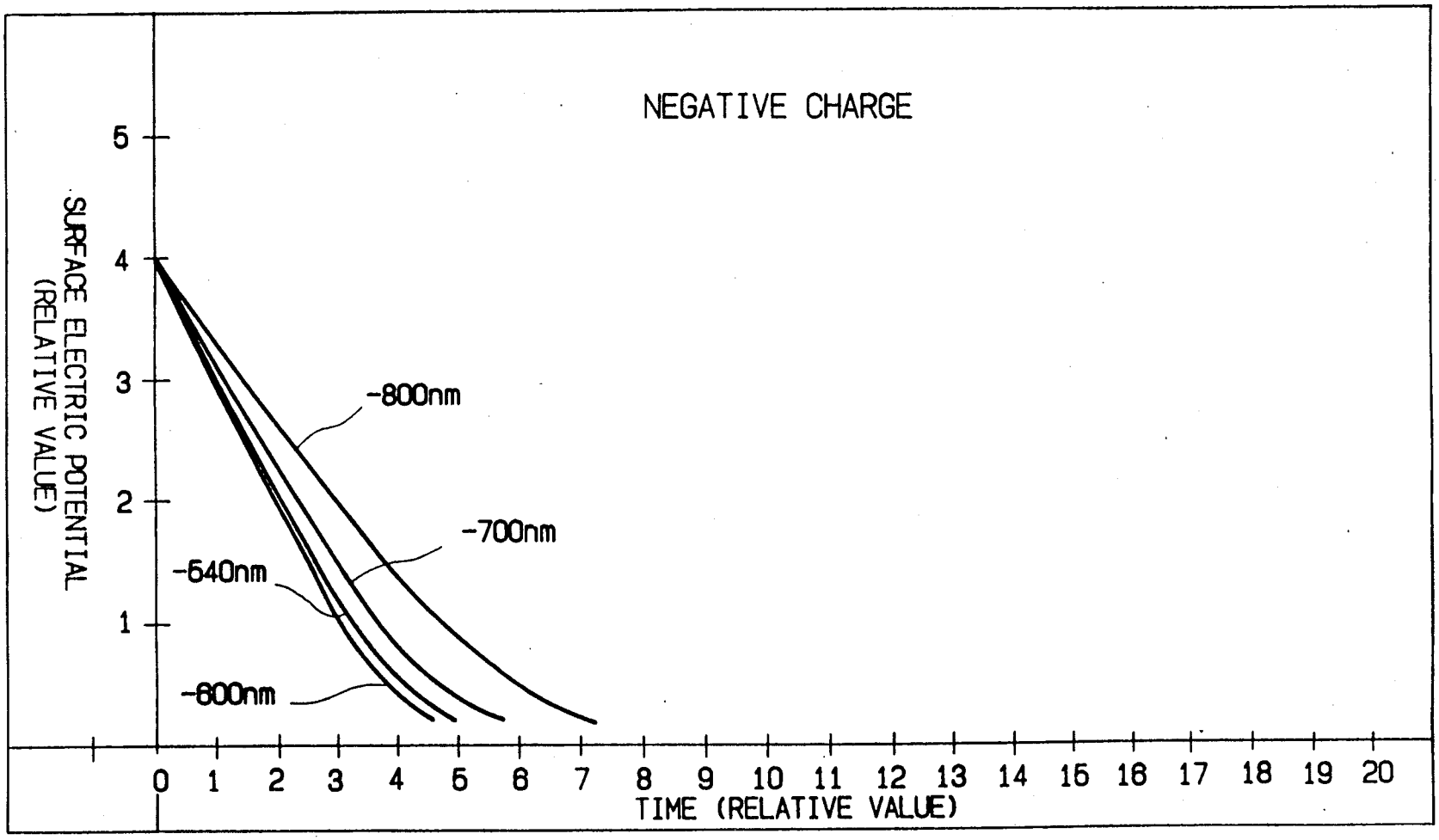
FIG. 9 shows optical attenuation curves for a surface electric potential in relation of the lapse of time under negative charge on the resultant electrophotographic image-forming member in the later described example.
Figure 10:
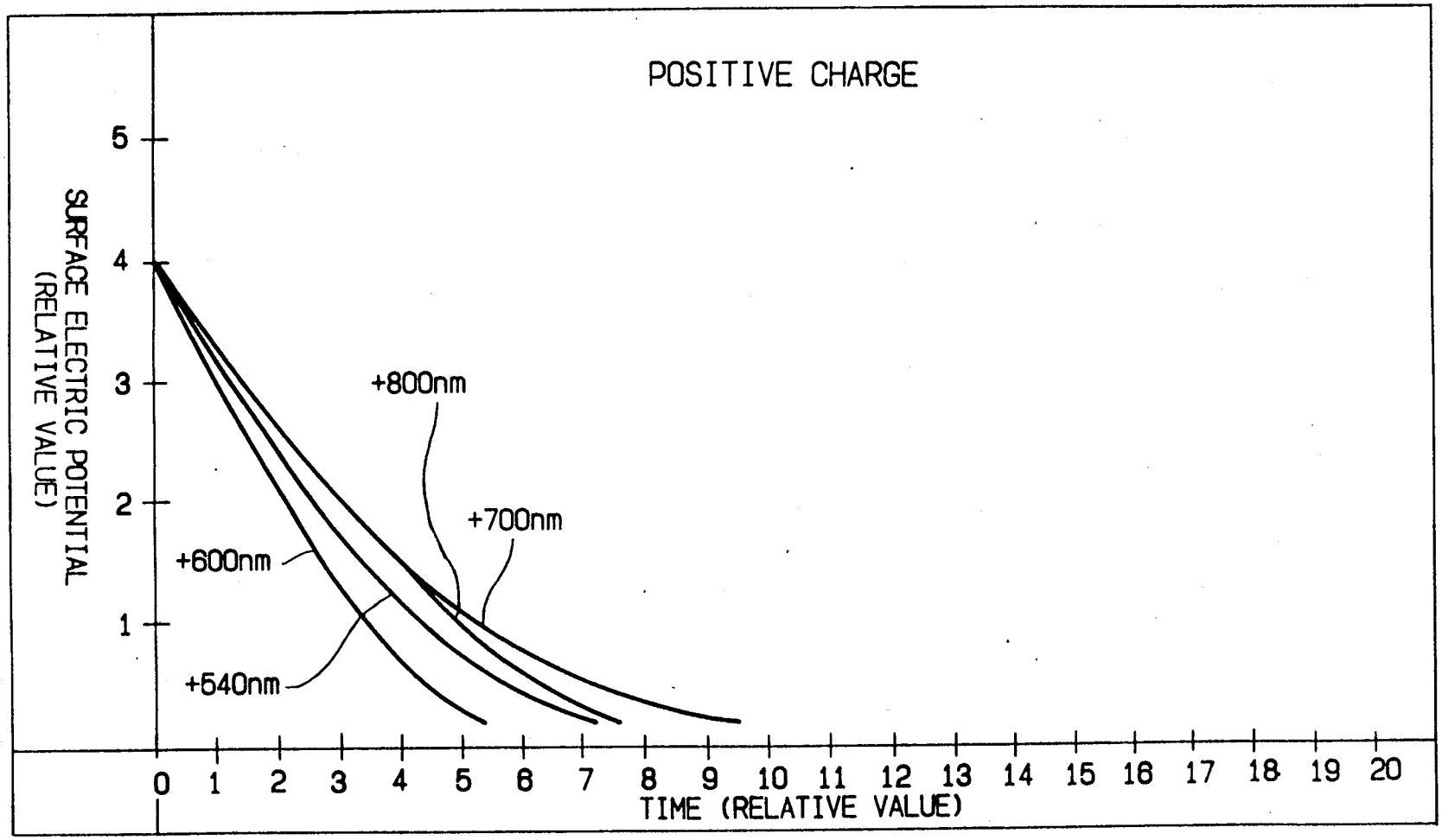
FIG. 10 shows optical attenuation curves for a surface electric potential in relation of the lapse of time under positive charge on the resultant electrophotographic image-forming member in the later described example.

The results obtained were collectively shown in FIG. 9 (negative charge) and in FIG. 10 (positive charge).

From the results shown in FIG. 9 and FIG. 10, it is understood that the electrophotographic image-forming member of Sample No. 111 exhibits desirable characteristics either in negative corona charge or in positive corona charge.

EXAMPLE 4 AND COMPARATIVE EXAMPLE 4

The foregoing procedures for practicing the MW-PCVD process using the MW-PCVD apparatus (2.45 GHz) shown in FIGS. 6(A) and 6(B) were conducted under the film-forming conditions shown in Table 6 in which the mark A means the film-forming conditions other than the present invention and the mark B means the film-forming conditions of the present invention, to thereby prepare 14 non-single-crystal silicon carbide film sample groups (Samples Nos. 201 to 214), each sample group containing 6 non-single-crystal silicon carbide film samples.

In each sample group, there were placed a pair of a glass plate and a Si-wafer plate respectively of 1 inch×2 inch in size in the respective channels formed at the upper part of each of 6 cylindrical aluminum sample holders 605 respectively of 108 mm in outer diameter, 360 mm in length and 5 mm in thickness in the deposition chamber 601. And a non-single-crystal silicon carbide film was formed on each of those glass plates and Si-wafer places. As the said glass plate, there was used a Corning's No. 7059 glass plate.

For the thus obtained samples, there were observed the film composition, the film structure and the film quality in the same manner as in Example 1.

The observed results obtained were collectively shown in Table 7. The values obtained through measurements shown in Table 7 are average value among the six samples.

The sample's identification numbers in Table 7 are corresponding those in Table 6.

From the results shown in Table 7, it has been recognized that any of the resultant films of Sample Nos. 211, 212, 213 and 214 are corresponding to the specific non-single-crystal silicon carbide film according to the present invention, that is, a non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum. It has been also recognized that any of the above four films is of the characteristic energy (Ec) being lower that for any of the remaining comparative films and excels in film quality.

COMPARATIVE EXAMPLE 5

In this comparative example, in accordance with a RF (13.56 MHz)-glow discharge decomposition method using the film-forming apparatus shown in FIG. 7 which is suitable for practicing said RF-glow discharge decomposition method, there was formed a film on a Corning's No. 7059 glass plate and also on a Si-wafer plate respectively of 1 inch×2 inch in size being placed in the respective channels formed at the upper part of a cylindrical aluminum sample holder 703' of 108 mm in outer diameter, 360 mm in length and 5 mm in thickness in the deposition chamber 701 under the film-forming conditions for Sample No. 215 shown in Table 8.

The film-forming process was carried out in the way as hereunder mentioned.

Firstly, the foregoing cylindrical aluminum sample holder having said glass plate and said Si-wafer plate arranged thereon was placed on the substrate holder 703. Then, the exhaust valve 705 was opened and the deposition space of the deposition chamber 701 was evacuated by operating a vacuum pump (not shown).

Upon the reading of the vacuum gauge 704 having become $1\times10^{-3}$ Torr, SiH gas and $H_2$gas were introduced though a feed valve 707 and the feed pipe 711 into the deposition space of the deposition chamber 701 and at the same time, $C_2H_2$ gas was introduced through the feed valve 708 and the feed pipe 702 into the said deposition space.

The temperature of the cylindrical aluminum sample holder 703' was controlled by means of the electric heater 706.

After the preliminary arrangements being thus completed, a RF-power source (not shown) was switched on to thereby apply a RF power into the deposition space of the deposition chamber 701. Thus, there was formed a deposited film on each of the glass plate and the Si-wafer plate.

The films thus obtained were evaluated in the same way as in Example 1.

The evaluated results were as shown in Table 9. As Table 9 illustrates, it is understood that in the case of forming a non-single-crystal silicon carbide film in accordance with the RF-glow discharge decomposition method, the amount of hydrogen atoms to be taken into the resulting film becomes increased and the proportion of graphite domains formed in the resulting film becomes great.

EXAMPLE 5 AND COMPARATIVE EXAMPLE 6

In Example 5, there were prepared a plurality of electrophotographic image-forming member samples each having the configuration shown in FIG. 1(B) which comprises a substrate 101 comprising a cylindrical aluminum substrate of 108 mm in outer diameter, 360 mm in length and 5 mm in thickness and a light receiving layer comprising a 3 μm thick charge injection inhibition layer 103 formed of a specific doped non-single-crystal silicon carbide film and a 25 μm thick photoconductive layer 102 formed of a specific non-doped non-single-crystal silicon carbide film under the film-forming conditions shown in Table 10.

Likewise, in Comparative Example 6, there were prepared a plurality of electrophotographic image-forming members having the configuration shown in FIG. 1(B) under the film-forming conditions shown in Table 11.

Each of the electrophotographic image-forming members thus prepared was evaluated in the same way as in Example 2.

The evaluated results obtained were as shown in Table 12.

All the values shown therein are relative ones. From what shown in Table 12, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 311, 312, 313 and 314 belonging to the present invention are surpassing the remaining comparative electrophotographic image-forming member samples in any of the above evaluation items and they are particularly suited for use in a high-speed electrophotographic copying system.

EXAMPLE 6 AND COMPARATIVE EXAMPLE 7

In Example 6, there were prepared a plurality of electrophotographic image-forming member samples each having the configuration shown in FIG. 1(B) which comprises a substrate 101 comprising a cylindrical aluminum substrate of 108 mm in outer diameter, 360 mm in length and 5 mm in thickness and a light receiving layer comprising a 3 μm thick charge injection inhibition layer 103 formed of a specific doped non-single-crystal silicon carbide film and a 25 μm thick photoconductive layer 102 formed of a specific non-doped non-single-crystal silicon carbide film under the film-forming conditions shown in Table 13.

Likewise, in Comparative Example 6, there were prepared a plurality of electrophotographic image-forming members having the configuration shown in FIG. 1(B) under the film-forming conditions shown in Table 14.

Each of the electrophotographic image-forming members thus prepared was evaluated in the same way as in Example 2.

The evaluated results obtained were as shown in Table 15.

All the values shown therein are relative ones. From what shown in Table 15, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 411, 412, 413 and 414 belonging to the present invention are surpassing the remaining comparative electrophotographic image-forming member samples in any of the above evaluation items and they are particularly suited for use in a high-speed electrophotographic copying system.

EXAMPLE 7 AND COMPARATIVE EXAMPLE 8

In Example 7, there were prepared a plurality of electrophotographic image-forming member samples each having the configuration shown in FIG. 1(B) which comprises a substrate 101 comprising a cylindrical aluminum substrate of 108 mm in outer diameter, 360 mm in length and 5 mm in thickness and a light receiving layer comprising a 3 μm thick charge injection inhibition layer 103 formed of a specific doped non-single-crystal silicon carbide film and a 25 μm thick photoconductive layer 102 formed of a specific non-doped non-single-crystal silicon carbide film under the film-forming conditions shown in Table 16.

Likewise, in Comparative Example 6, there were prepared a plurality of electrophotographic image-forming members having the configuration shown in FIG. 1(B) under the film-forming conditions shown in Table 17.

Each of the electrophotographic image-forming members thus prepared was evaluated in the same way as in Example 2.

The results thus obtained are collectively shown in Table 18. All the values shown therein are relative ones. From what shown in Table 18, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 511, 512, 513 and 514 belonging to the present invention are surpassing the remaining comparative electrophotographic image-forming member samples in any of the above evaluation items and they are particularly suited for use in a high-speed electrophotographic copying system.

EXAMPLE 8 AND COMPARATIVE EXAMPLE 9

There were prepared a plurality of electrophotographic image-forming member samples each having the configuration shown in FIG. 1(B) which comprises a substrate 101 comprising a cylindrical aluminum substrate of 108 mm in outer diameter, 360 mm in length and 5 mm in thickness and a light receiving layer comprising a 3 μm thick charge injection inhibition layer 103 formed of a doped non-single-crystal silicon carbide film and a 25 μm thick photoconductive layer 102 formed of a non-doped non-single-crystal silicon carbide film under the film-forming conditions shown in Table 19.

Each of the electrophotographic image-forming members thus prepared was evaluated in the same way as in Example 2.

The results thus obtained are collectively shown in Table 20. All the values shown therein are relative ones. From what shown in Table 20, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 611, 612, 613 and 614 belonging to the present invention are surpassing the remaining comparative electrophotographic image-forming member samples in any of the above evaluation items and they are particularly suited for use in a high-speed electrophotographic copying system.

EXAMPLE 9 AND COMPARATIVE EXAMPLE 10

The foregoing procedures for practicing the MW-PCVD process using the MW-PCVD apparatus (2.45 GHz) shown in FIGS. 6(A) and 6(B) were conducted under the film-forming conditions shown in Table 21 in which the mark A means the film-forming conditions other than the present invention and the mark B means the film-forming conditions of the present invention, to thereby prepare 14 non-single-crystal silicon carbide film sample groups (Samples Nos. 701 to 714), each sample group containing 6 non-single-crystal silicon carbide film samples.

In each sample group, there were placed a pair of a glass plate and a Si-wafer plate respectively of 1 inch×2 inch in size in the respective channels formed at the upper part of each of 6 cylindrical aluminum sample holders 605 respectively of 108 mm in outer diameter, 360 mm in length and 5 mm in thickness in the deposition chamber 601. And a non-single-crystal silicon carbide film was formed on each of those glass plates and Si-wafer places. As the said glass plate, there was used a Corning's No. 7059 glass plate.

For the thus obtained samples, there were observed the film composition, the film structure and the film quality in the same manner as in Example 1.

The observed results obtained were collectively shown in Table 22. The values obtained through measurements shown in Table 22 are average value among the six samples.

The sample's identification numbers in Table 22 are corresponding those in Table 21.

From the results shown in Table 22, it has been recognized that any of the resultant films of Sample Nos. 711, 712, 713 and 714 is corresponding the specific non-single-crystal silicon carbide film according to the present invention, that is, a non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum. It has been also recognized that any of the above four films is of the characteristic energy (Ec) being lower that for any of the remaining comparative films and excels in film quality.

COMPARATIVE EXAMPLE 11

In this comparative example, in accordance with a RF (13.56 MHz)-glow discharge decomposition method using the film-forming apparatus shown in FIG. 7 which is suitable for practicing said RF-glow discharge decomposition method, there was formed a film on a Corning's No. 7059 glass plate and also on a Si-wafer plate respectively of 1 inch×2 inch in size being placed in the respective channels formed at the upper part of a cylindrical aluminum sample holder 703' of 108 mm in outer diameter, 360 mm in length and 5 mm in thickness in the deposition chamber 701 under the film-forming conditions for Sample No. 715 shown in Table 23.

The film-forming process was carried out in the way as hereunder mentioned.

Firstly, the foregoing cylindrical aluminum sample holder having said glass plate and said Si-wafer plate arranged thereon was placed on the substrate holder 703. Then, the exhaust valve 705 was opened and the deposition space of the deposition chamber was evacuated by operating a vacuum pump (not shown).

Upon the reading of the vacuum gauge 704 having become $1\times10^{-3}$ Torr, SiH gas and $H_2$ gas were introduced though the feed valve 707 and the feed pipe 711 into the deposition space of the deposition chamber 701 and at the same time, $C_2H_2$ gas was introduced through the feed valve 708 and the feed pipe 702 into the said deposition space.

The temperature of the cylindrical aluminum sample holder 703' was controlled by means of the electric heater 706.

After the preliminary arrangements being thus completed, a RF-power source (not shown) was switched on to thereby apply a RF power into the deposition space of the deposition chamber 701. Thus, there was formed a deposited film on each of the glass plate and the Si-wafer plate.

The films thus obtained were evaluated in the same way as in Example 1.

The evaluated results were as shown in Table 24. As Table 24 illustrates, it is understood that in the case of forming a non-single-crystal silicon carbide film in accordance with the RF-glow discharge decomposition method, the amount of hydrogen atoms to be taken into the resulting film becomes increased and the proportion of graphite domains formed in the resulting film becomes great.

EXAMPLE 10 AND COMPARATIVE EXAMPLE 12

The foregoing procedures for practicing the MW-PCVD process using the MW-PCVD apparatus shown in FIGS. 6(A) and 6(B) were conducted under the film-forming conditions shown in Table 25 in which the mark A means the film-forming conditions other than the present invention and the mark B means the film-forming conditions of the present invention, to thereby prepare 7 non-single-crystal silicon carbide film sample groups (Samples Nos. 801 to 807), each sample group containing 6 non-single-crystal silicon carbide film samples.

In each sample group, there were placed a pair of a glass plate and a Si-wafer plate respectively of 1 inch×2 inch in size in the respective channels formed at the upper part of each of 6 cylindrical aluminum sample holders 605 respectively of 108 mm in outer diameter, 360 mm in length and 5 mm in thickness in the deposition chamber 601. And a non-single-crystal silicon carbide film was formed on each of those glass plates and Si-wafer places. As the said glass plate, there was used a Corning's No. 7059 glass plate.

For the thus obtained samples, there were observed the film composition, the film structure and the film quality in the same manner as in Example 1.

The observed results obtained were collectively shown in Table 26. The values obtained through measurements shown in Table 26 are average value among the six samples.

The sample's identification numbers in Table 26 are corresponding to those in Table 25.

From the results shown in Table 26, it has been recognized that any of the resultant films of Sample Nos. 805, 806 and 807 excels in quality, and is surpassing the remaining resultant films in view of not only characteristic energy (Ec) but also other characteristics, which is therefore desirably suited to be the surface layer 104 in the electrophotographic image-forming member of the present invention. And, it has been confirmed that any of the non-single-crystal silicon carbide film is: a non-single-crystal silicon carbide film containing silicon atoms as a matrix, carbon atoms in an amount of 20 to 40 atomic % and hydrogen atoms in an amount of 50 to 70 atomic % and containing graphite structure domains in a proportion of 1 or less per unit volume.

EXAMPLE 11 AND COMPARATIVE EXAMPLE 13

In each of Example 11 and Comparative Example 13, there were prepared a plurality of electrophotographic image-forming members each having the configuration shown in FIG. 1(C) which comprises a cylindrical aluminum substrate 101 of 108 mm in outer diameter, 360 mm in length and 5 mm in thickness and a light receiving layer comprising a 25 μm thick photoconductive layer 102 and a 0.5 μm thick surface layer 104.

In Example 11, said plurality of electrophotographic image-forming members were prepared under the film-forming conditions shown in Table 27.

In Comparative Example 13, said plurality of electrophotographic image-forming members were prepared under the film-forming conditions shown in Table 28.

Each of the thus prepared electrophotographic image-forming members was evaluated in the same manner as in Example 2.

The results thus obtained were collectively shown in Table 29. All the values shown therein are relative ones. From what shown in Table 29, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 911, 912, 913 and 914 belonging to the present invention are surpassing the remaining comparative electrophotographic image-forming member samples in any of the above evaluation items and they are particularly suited for use in a high-speed electrophotographic copying system.

And, the phenomenon of a decrease in the initial surface electric potential was observed on any of the comparative electrophotographic image-forming members (Sample Nos. 901-910 and 915), but such phenomenon was not observed on any of the electrophotographic image-forming members belonging to the present invention (Sample Nos. 911-914).

EXAMPLE 12 AND COMPARATIVE EXAMPLE 14

There were prepared a plurality of electrophotographic image-forming members each having the configuration shown in FIG. 1(D) which comprises a cylindrical aluminum substrate of 108 mm in outer diameter, 360 mm in length and 5 mm in thickness and a light receiving layer comprising a 3 μm thick charge injection inhibition layer 103 (first layer), a 25 μm thick photoconductive layer 102 (second layer) and a 0.5 μm thick surface layer 104 (third layer), under the film-forming conditions shown in Tables 30 and 31.

Each of the thus prepared electrophotographic image-forming members was evaluated in the same manner as in Example 2.

The results thus obtained were collectively shown in Table 32. All the values shown therein are relative ones. From what shown in Table 32, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 1011, 1012, 1013 and 1014 belonging to the present invention are surpassing the remaining comparative electrophotographic image-forming member samples in any of the above evaluation items and they are particularly suited for use in a high-speed electrophotographic copying system.

And, the phenomenon of a decrease in the initial surface electric potential was observed on any of the comparative electrophotographic image-forming members (Sample Nos. 1001-1010 and 1015), but such phenomenon was not observed on any of the electrophotographic image-forming members belonging to the present invention (Sample Nos. 1011-1014).

EXAMPLE 13 AND COMPARATIVE EXAMPLE 15

There were prepared a plurality of electrophotographic image-forming members each having the configuration shown in FIG. 1(D) which comprises a cylindrical aluminum substrate of 108 mm in outer diameter, 360 mm in length and 5 mm in thickness and a light receiving layer comprising a 3 μm thick charge injection inhibition layer 103 (first layer), a 25 μm thick photoconductive layer 102 (second layer) and a 0.5 μm thick surface layer 104 (third layer), under the film-forming conditions shown in Tables 33.

Each of the thus prepared electrophotographic image-forming members was evaluated in the same manner as in Example 2.

The results thus obtained were collectively shown in Table 34. All the values shown therein are relative ones. From what shown in Table 34, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 1111, 1112, 1113 and 1114 belonging to the present invention are surpassing the remaining comparative electrophotographic image-forming member samples in any of the above evaluation items and they are particularly suited for use in a high-speed electrophotographic copying system.

And, the phenomenon of a decrease in the initial surface electric potential was observed on any of the comparative electrophotographic image-forming members (Sample Nos. 1101-1110 and 1115), but such phenomenon was not observed on any of the electrophotographic image-forming members belonging to the present invention (Sample Nos. 1111-1114).

EXAMPLE 14 AND COMPARATIVE EXAMPLE 16

There were prepared a plurality of electrophotographic image-forming members each having the configuration shown in FIG. 1(D) which comprises a cylindrical aluminum substrate of 108 mm in outer diameter, 360 mm in length and 5 mm in thickness and a light receiving layer comprising a 3 μm thick charge injection inhibition layer 103 (first layer), a 25 μm thick photoconductive layer 102 (second layer) and a 0.5 μm thick surface layer 104 (third layer), under the film-forming conditions shown in Tables 35.

Each of the thus prepared electrophotographic image-forming members was evaluated in the same manner as in Example 2.

The results thus obtained were collectively shown in Table 36. All the values shown therein are relative ones. From what shown in Table 36, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 1211, 1212, 1213 and 1214 belonging to the present invention are surpassing the remaining comparative electrophotographic image-forming member samples in any of the above evaluation items and they are particularly suited for use in a high-speed electrophotographic copying system.

And, the phenomenon of a decrease in the initial surface electric potential was observed on any of the comparative electrophotographic image-forming members (Sample Nos. 1201-1210 and 1215), but such phenomenon was not observed on any of the electrophotographic image-forming members belonging to the present invention (Sample Nos. 1211-1214).

EXAMPLE 15 AND COMPARATIVE EXAMPLE 17

There were prepared a plurality of electrophotographic image-forming members each having the configuration shown in FIG. 1(D) which comprises a cylindrical aluminum substrate of 108 mm in outer diameter, 360 mm in length and 5 mm in thickness and a light receiving layer comprising a 3 μm thick charge injection inhibition layer 103 (first layer), a 25 μm thick photoconductive layer 102 (second layer) and a 0.5 μm thick surface layer 104 (third layer), under the film-forming conditions shown in Tables 37.

Each of the thus prepared electrophotographic image-forming members was evaluated in the same manner as in Example 2.

The results thus obtained were collectively shown in Table 38. All the values shown therein are relative ones. From what shown in Table 38, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 1305, 1306, 1307 belonging to the present invention are surpassing the remaining comparative electrophotographic image-forming member samples in any of the above evaluation items and they are particularly suited for use in a high-speed electrophotographic copying system.

And, the phenomenon of a decrease in the initial surface electric potential was observed on any of the comparative electrophotographic image-forming members (Sample Nos. 1301-1304), but such phenomenon was not observed on any of the electrophotographic image-forming members belonging to the present invention (Sample Nos. 1305-1307).

EXAMPLE 16 AND COMPARATIVE EXAMPLE 18

There were prepared a plurality of electrophotographic image-forming members each having the configuration shown in FIG. 1(D) which comprises a cylindrical aluminum substrate of 108 mm in outer diameter, 360 mm in length and 5 mm in thickness and a light receiving layer comprising a 3 μm thick charge injection inhibition layer 103 (first layer), a 25 μm thick photoconductive layer 102 (second layer) and a 0.5 μm thick surface layer 104 (third layer), under the film forming conditions shown in Tables 39.

Each of the thus prepared electrophotographic image-forming members was evaluated in the same manner as in Example 2.

The results thus obtained were collectively shown in Table 40. All the values shown therein are relative ones. From what shown in Table 40, it is understood that as for the charge retentivity, the better, the smaller the value is: as for the dark decay, the better, the smaller the value is: and as for both the ghost appearance and the optical attenuation, the better, the smaller the value is.

In consequence of the above, it has been confirmed that all the electrophotographic image-forming member samples i.e. Sample Nos. 1405, 1406, 1407 belonging to the present invention are surpassing the remaining comparative electrophotographic image-forming member samples in any of the above evaluation items and they are particularly suited for use in a high-speed electrophotographic copying system.

And, the phenomenon of a decrease in the initial surface electric potential was observed on any of the comparative electrophotographic image-forming members (Sample Nos. 1401-1404), but such phenomenon was not observed on any of the electrophotographic image-forming members belonging to the present invention (Sample Nos. 1405-1407).

TABLE 1

| sample no. | flow rate of gas used (sccm) | | the position where gas introduced(*) | μW power (kW) | inner pressure (mTorr) | bias voltage (V/A) | substrate temperature (°C.) |
|---|---|---|---|---|---|---|---|
| 001 | $SiH_4$ | 500 | A | 3.5 | 13 | 100/7 | 300 |
| | $CH_4$ | 100 | | | | | |
| | $H_2$ | 1000 | | | | | |
| 002 | $SiH_4$ | 500 | A | 4 | 8 | 100/8 | 280 |
| | $CH_4$ | 5 | | | | | |
| | $H_2$ | 1000 | | | | | |
| 003 | $SiH_4$ | 500 | A | 5 | 5 | 0/0 | 300 |
| | $CH_4$ | 50 | | | | | |
| | $H_2$ | 1000 | | | | | |
| 004 | $SiH_4$ | 500 | A | 6 | 5 | 120/13 | 180 |
| | $CH_4$ | 100 | | | | | |
| | $H_2$ | 1000 | | | | | |
| 005 | $SiH_4$ | 500 | A | 5 | 1 | 150/10 | 450 |
| | $CH_4$ | 150 | | | | | |
| | $H_2$ | 500 | | | | | |
| 006 | $SiH_4$ | 500 | A | 2 | 7 | 150/15 | 280 |
| | $CH_4$ | 200 | | | | | |
| | $H_2$ | 1000 | | | | | |
| 007 | $SiH_4$ | 500 | A | 1 | 9 | 100/10 | 300 |
| | $CH_4$ | 200 | | | | | |
| | $H_2$ | 1000 | | | | | |
| 008 | $SiH_4$ | 500 | A | 4 | 0.4 | 120/10 | 300 |
| | $CH_4$ | 50 | | | | | |
| | $H_2$ | 1000 | | | | | |
| 009 | $SiH_4$ | 500 | A | 4 | 4 | 100/11 | 350 |

TABLE 1-continued

| sample no. | flow rate of gas used (sccm) | the position where gas introduced(*) | μW power (kW) | inner pressure (mTorr) | bias voltage (V/A) | substrate temperature (°C.) |
|---|---|---|---|---|---|---|
| | $CH_4$ 600<br>$H_2$ 1000 | | | | | |
| 010 | $SiH_4$ 500<br>$CH_4$ 100<br>$H_2$ 1000 | A | 9 | 1 | 150/11 | 300 |
| 011 | $SiH_4$ 500<br>$CH_4$ 30<br>$H_2$ 1000 | B | 4 | 0.6 | 120/10 | 280 |
| 012 | $SiH_4$ 500<br>$CH_4$ 60<br>$H_2$ 1000 | B | 5 | 4 | 130/10 | 380 |
| 013 | $SiH_4$ 500<br>$CH_4$ 200<br>$H_2$ 1000 | B | 6 | 5 | 130/12 | 220 |
| 014 | $SiH_4$ 500<br>$CH_4$ 100<br>$H_2$ 1000 | B | 4 | 9 | 150/10 | 280 |

(*)A: all the gases were introduced through the feed pipe 611.
B: silane gas and $H_2$ gas were introduced through the feed pipe 611 and $CH_4$ gas was introduced through the feed pipe 608.

TABLE 2

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 001 | 11 | 12 | 0.3 | 3 | 100 | 1 |
| 002 | 0.9 | 6 | 0.4 | 2 | 100 | 0.9 |
| 003 | 8 | 15 | 0.6 | 4 | 100 | 1.1 |
| 004 | 10 | 16 | 0.5 | 5 | 100 | 1.3 |
| 005 | 5 | 4.8 | 0.2 | 2 | 100 | 1.2 |
| 006 | 5 | 15 | 0.5 | 3 | 100 | 1.5 |
| 007 | 10 | 11 | 0.4 | 3 | 100 | 1.1 |
| 008 | 1 | 7 | 0.3 | 2 | 100 | 1.1 |
| 009 | 7 | 40 | 1 | 10 | 100 | 2.0 |
| 010 | 0.1 | 13 | 0.4 | 3 | 100 | 1.1 |
| 011 | 5 | 5 | 0.02 | 0.4 | 100 | 0.5 |
| 012 | 9 | 15 | 0.03 | 0.4 | 100 | 0.5 |
| 013 | 8 | 12 | 0.05 | 1.0 | 100 | 0.6 |
| 014 | 3 | 7 | 0.04 | 0.3 | 100 | 0.3 |

TABLE 3

| sample no. | flow rate of gas used (sccm) | the position where gas introduced(*) | RF power (kW) | inner pressure (mTorr) | bias voltage (V/A) | substrate temperature (°C.) |
|---|---|---|---|---|---|---|
| 015 | $SiH_4$ 1000<br>$C_2H_2$ 100<br>$H_2$ 5000 | A | 2 | 500 | 0/0 | 300 |

(*)A: silane gas and $H_2$ gas were introduced through the feed pipe 709 and $C_2H_2$ gas was introduced through the feed pipe 710.

TABLE 4

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 015 | 25 | 15 | 0.06 | 8.0 | 100 | 1.1 |

TABLE 5

| sample no. (no. of the film-forming condition) | charge retentivity (relative value) | dark decay (relative value) | photo-sensitivity (relative value) | ghost (relative value) |
|---|---|---|---|---|
| 101 (001) | 1 | 100 | 100 | 100 |
| 102 (002) | 0.9 | 110 | 120 | 100 |
| 103 (003) | 1 | 100 | 100 | 90 |

TABLE 5-continued

| sample no. (no. of the film-forming condition) | charge retentivity (relative value) | dark decay (relative value) | photo-sensitivity (relative value) | ghost (relative value) |
|---|---|---|---|---|
| 104 (004) | 0.8 | 120 | 130 | 110 |
| 105 (005) | 0.9 | 120 | 120 | 110 |
| 106 (006) | 1 | 90 | 100 | 90 |

TABLE 5-continued

| sample no. (no. of the film-forming condition) | charge retentivity (relative value) | dark decay (relative value) | photo-sensitivity (relative value) | ghost (relative value) |
|---|---|---|---|---|
| 107 (007) | 1 | 90 | 90 | 80 |
| 108 (008) | 1 | 100 | 90 | 100 |
| 109 (009) | 0.6 | 150 | 140 | 70 |
| 110 (010) | 0.5 | 160 | 150 | 110 |
| 111 (011) | 1.3 | 20 | 30 | 10 |
| 112 (012) | 1.5 | 10 | 30 | 5 |
| 113 (013) | 1.4 | 20 | 20 | 5 |
| 114 (014) | 1.2 | 30 | 10 | 10 |
| 115 (015) | 0.6 | 150 | 150 | 130 |

TABLE 6

| sample no. | flow rate of gas used (sccm) | | the position where gas introduced(*) | μW power (kW) | inner pressure (mTorr) | bias voltage (V/A) | substrate temperature (°C.) |
|---|---|---|---|---|---|---|---|
| 201 | $SiH_4$ | 500 | A | 3.0 | 14 | 100/8 | 280 |
| | $CH_4$ | 80 | | | | | |
| | $H_2$ | 1000 | | | | | |
| 202 | $SiH_4$ | 500 | A | 4.0 | 10 | 120/7 | 300 |
| | $CH_4$ | 10 | | | | | |
| | $H_2$ | 1000 | | | | | |
| 203 | $SiH_4$ | 500 | A | 4.5 | 7 | 0/0 | 280 |
| | $CH_4$ | 80 | | | | | |
| | $H_2$ | 1000 | | | | | |
| 204 | $SiH_4$ | 500 | A | 5 | 6 | 100/12 | 150 |
| | $CH_4$ | 100 | | | | | |
| | $H_2$ | 1000 | | | | | |
| 205 | $SiH_4$ | 500 | A | 6 | 2 | 150/10 | 500 |
| | $CH_4$ | 150 | | | | | |
| | $H_2$ | 1000 | | | | | |
| 206 | $SiH_4$ | 500 | A | 1.5 | 8 | 120/10 | 300 |
| | $CH_4$ | 200 | | | | | |
| | $H_2$ | 1000 | | | | | |
| 207 | $SiH_4$ | 500 | A | 1 | 10 | 110/8 | 280 |
| | $CH_4$ | 200 | | | | | |
| | $H_2$ | 1000 | | | | | |
| 208 | $SiH_4$ | 500 | A | 4 | 0.3 | 150/10 | 300 |
| | $CH_4$ | 60 | | | | | |
| | $H_2$ | 1000 | | | | | |
| 209 | $SiH_4$ | 500 | A | 3 | 5 | 120/12 | 350 |
| | $CH_4$ | 700 | | | | | |
| | $H_2$ | 1000 | | | | | |
| 210 | $SiH_4$ | 500 | A | 10 | 2 | 100/15 | 300 |
| | $CH_4$ | 200 | | | | | |
| | $H_2$ | 600 | | | | | |
| 211 | $SiH_4$ | 500 | B | 4 | 0.6 | 120/10 | 280 |
| | $CH_4$ | 25 | | | | | |
| | $H_2$ | 1000 | | | | | |
| 212 | $SiH_4$ | 500 | B | 4.5 | 3 | 130/12 | 300 |
| | $CH_4$ | 60 | | | | | |
| | $H_2$ | 1000 | | | | | |
| 213 | $SiH_4$ | 500 | B | 5 | 9 | 150/12 | 380 |
| | $CH_4$ | 200 | | | | | |
| | $H_2$ | 900 | | | | | |
| 214 | $SiH_4$ | 500 | B | 4 | 7 | 100/11 | 300 |
| | $CH_4$ | 100 | | | | | |
| | $H_2$ | 1000 | | | | | |

(*)A: all the gases were introduced through the feed pipe 611.
B: silane gas and $H_2$ gas were introduced through the feed pipe 611 and $CH_4$ gas was introduced through the feed pipe 608.

TABLE 7

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 201 | 10 | 11 | 0.4 | 3 | 100 | 1 |
| 202 | 1 | 7 | 0.3 | 3 | 100 | 1 |
| 203 | 7 | 12 | 0.55 | 5 | 100 | 1.1 |
| 204 | 9 | 15 | 0.4 | 6 | 100 | 1.4 |
| 205 | 6 | 4.5 | 0.3 | 2 | 100 | 1.2 |
| 206 | 4 | 15 | 0.4 | 3 | 100 | 1.5 |
| 207 | 9 | 10 | 0.3 | 2 | 100 | 1.1 |
| 208 | 0.9 | 9 | 0.5 | 3 | 100 | 0.9 |

TABLE 7-continued

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 209 | 6 | 35 | 1.2 | 9 | 100 | 2.0 |
| 210 | 0.1 | 10 | 0.3 | 3 | 100 | 1.0 |
| 211 | 4 | 5 | 0.02 | 0.4 | 100 | 0.5 |
| 212 | 6 | 15 | 0.03 | 0.3 | 100 | 0.5 |
| 213 | 7 | 11 | 0.05 | 1.0 | 100 | 0.55 |
| 214 | 5 | 9 | 0.04 | 0* | 100 | 0.3 |

*less than detection limit

TABLE 8

| sample no. | flow rate of gas used (sccm) | the position where gas introduced(*) | RF power (kW) | inner pressure (mTorr) | bias voltage (V/A) | substrate temperature (°C.) |
|---|---|---|---|---|---|---|
| 215 | $SiH_4$ 1200<br>$C_2H_2$ 120<br>$H_2$ 6000 | A | 3 | 600 | 0/0 | 300 |

(*)A: silane gas and $H_2$ gas were introduced through the feed pipe 709 and $C_2H_2$ gas was introduced through the feed pipe 710.

TABLE 9

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 215 | 18 | 17 | 0.07 | 10.0 | 100 | 1.0 |

TABLE 10

| | film-forming conditions | layer thickness (μm) |
|---|---|---|
| charge injection inhibition layer | the film-forming conditions for samples nos. 211-214 shown in Table 6 were employed and $B_2H_6$ was introduced in an amount of 1000 ppm against $SiH_4$. | 3 |
| photoconductive layer | formed under the film-forming conditions for samples nos. 211-214 shown in Table 6 | 25 |

TABLE 11

| | film-forming conditions | layer thickness (μm) |
|---|---|---|
| charge injection inhibition layer | the film-forming conditions for sample nos. 201-210 and 215 shown in Tables 6 and 8 were employed and $B_2H_6$ was introduced in an amount of 1000 ppm against $SiH_4$. | 3 |
| photoconductive layer | formed under the film-forming conditions for sample nos. 201-210 and 215 shown in Tables 6 and 8 | 25 |

TABLE 12

| sample no. (no. of the film-forming condition) (charge injection inhibition layer/ photoconductive layer) | charge retentivity (relative value) | dark decay (relative value) | photosensitivity (relative value) | ghost (relative value) |
|---|---|---|---|---|
| 301 (201/201) | 1 | 100 | 100 | 100 |
| 302 (202/202) | 1 | 110 | 100 | 90 |
| 303 (203/203) | 0.9 | 100 | 120 | 100 |
| 304 (204/204) | 1 | 120 | 100 | 80 |
| 305 (205/205) | 0.8 | 100 | 110 | 110 |
| 306 (206/206) | 1 | 110 | 100 | 110 |
| 307 (207/207) | 1 | 120 | 120 | 70 |
| 308 (208/208) | 0.7 | 100 | 100 | 100 |
| 309 (209/209) | 0.9 | 90 | 100 | 100 |
| 310 (210/210) | 0.9 | 110 | 120 | 80 |
| 311 (211/211) | 1.4 | 30 | 20 | 5 |
| 312 (212/212) | 1.3 | 10 | 20 | 10 |
| 313 (213/213) | 1.5 | 10 | 30 | 5 |
| 314 (214/214) | 1.2 | 20 | 10 | 10 |
| 315 (215/215) | 0.7 | 140 | 150 | 150 |

TABLE 13

| | film-forming conditions | layer thickness (μm) |
|---|---|---|
| charge injection inhibition layer | the film-forming conditions for samples nos. 211-214 shown in Table 6 were employed and $B_2H_6$ was introduced in an amount of 200 ppm against $SiH_4$. | 3 |
| photoconductive layer | formed under the film-forming conditions for samples nos. 211-214 shown in Table 6 | 25 |

TABLE 14

| | film-forming conditions | layer thickness (μm) |
|---|---|---|
| charge injection inhibition layer | the film-forming conditions for sample nos. 201-210 and 215 shown in Tables 6 and 8 were employed and $B_2H_6$ was introduced in an amount of 200 ppm against $SiH_4$. | 3 |
| photoconductive layer | formed under the film-forming conditions for sample nos. 201-210 and 215 shown in Tables 6 and 8 | 25 |

TABLE 15

| sample no. (no. of the film-forming condition) (charge injection inhibition layer/ photoconductive layer) | charge retentivity (relative value) | dark decay (relative value) | photosensitivity (relative value) | ghost (relative value) |
|---|---|---|---|---|
| 401 (201/201) | 1 | 100 | 100 | 100 |
| 402 (202/202) | 1 | 110 | 100 | 110 |
| 403 (203/203) | 0.9 | 90 | 90 | 100 |
| 404 (204/204) | 0.8 | 100 | 100 | 110 |
| 405 (205/205) | 1.1 | 100 | 110 | 100 |
| 406 (206/206) | 1 | 100 | 110 | 90 |
| 407 (207/207) | 0.9 | 90 | 100 | 90 |
| 408 (208/208) | 1 | 110 | 100 | 110 |
| 409 (209/209) | 1 | 110 | 110 | 100 |
| 410 (210/210) | 0.9 | 100 | 100 | 100 |
| 411 (211/211) | 1.4 | 30 | 20 | 10 |
| 412 (212/212) | 1.2 | 20 | 20 | 5 |
| 413 (213/213) | 1.5 | 20 | 30 | 5 |
| 414 (214/214) | 1.4 | 10 | 20 | 5 |
| 415 (215/215) | 0.7 | 140 | 150 | 170 |

TABLE 16

| | film-forming conditions | layer thickness (μm) |
|---|---|---|
| charge injection inhibition layer | the film-forming conditions for sample nos. 211-214 shown in Table 6 were employed and $PH_3$ was introduced in an amount of 3000 ppm against $SiH_4$. | 3 |
| photoconductive layer | formed under the film-forming conditions for samples nos. 211-214 shown in Table 6 | 25 |

TABLE 17

| | film-forming conditions | layer thickness (μm) |
|---|---|---|
| change injection inhibition layer | the film-forming conditions for sample nos. 201-210 and 215 shown in Tables 6 and 8 were employed and $PH_3$ was introduced in an amount of 3000 | 3 |

TABLE 17-continued

| | film-forming conditions | layer thickness (μm) |
|---|---|---|
| | ppm against $SiH_4$. | |
| photoconductive layer | formed under the film-forming conditions for sample nos. 201–210 and 215 shown in Tables 6 and 8 | 25 |

TABLE 18

| sample no. (no. of the film-forming condition) (charge injection inhibition layer/ photoconductive layer) | charge retentivity (relative value) | dark decay (relative value) | photosensitivity (relative value) | ghost (relative value) |
|---|---|---|---|---|
| 501 (201/201) | 1 | 100 | 100 | 100 |
| 502 (202/202) | 0.9 | 110 | 100 | 90 |
| 503 (203/203) | 0.8 | 100 | 100 | 90 |
| 504 (204/204) | 1 | 100 | 90 | 110 |
| 505 (205/205) | 1.1 | 90 | 100 | 110 |
| 506 (206/206) | 0.9 | 90 | 100 | 110 |
| 507 (207/207) | 1 | 100 | 90 | 100 |
| 508 (208/208) | 1 | 110 | 90 | 90 |
| 509 (209/209) | 1 | 100 | 110 | 110 |
| 510 (210/210) | 0.9 | 100 | 90 | 100 |
| 511 (211/211) | 1.5 | 20 | 20 | 5 |
| 512 (212/212) | 1.5 | 20 | 30 | 5 |
| 513 (213/213) | 1.6 | 30 | 20 | 5 |
| 514 (214/214) | 1.5 | 20 | 10 | 10 |
| 515 (215/215) | 0.8 | 140 | 120 | 160 |

TABLE 19

| | film-forming conditions | layer thickness (μm) |
|---|---|---|
| charge injection inhibition layer | the film-forming conditions for samples nos. 201–214 shown in Table 6 were employed and $B_2H_6$ was introduced in an amount of 3000 ppm against $SiH_4$. | 3 |
| photoconductive layer | the film-forming conditions for samples nos. 201–214 shown in Table 6 were employed and $B_2H_6$ was introduced in an amount of 1 ppm against $SiH_4$. | 25 |

TABLE 20

| sample no. (no. of the film-forming condition) (charge injection inhibition layer/ photoconductive layer) | charge retentivity (relative value) | dark decay (relative value) | photosensitivity (relative value) | ghost (relative value) |
|---|---|---|---|---|
| 601 (201/201) | 1 | 100 | 100 | 100 |
| 602 (202/202) | 0.9 | 90 | 110 | 100 |
| 603 (203/203) | 1 | 100 | 90 | 90 |
| 604 (204/204) | 1 | 100 | 90 | 90 |
| 605 (205/205) | 1 | 90 | 90 | 100 |
| 606 | 0.9 | 80 | 100 | 110 |

TABLE 20-continued

| sample no. (no. of the film-forming condition) (charge injection inhibition layer/ photoconductive layer) | charge retentivity (relative value) | dark decay (relative value) | photosensitivity (relative value) | ghost (relative value) |
|---|---|---|---|---|
| (206/206) 607 | 1 | 100 | 100 | 80 |
| (207/207) 608 | 1 | 90 | 110 | 100 |
| (208/208) 609 | 0.9 | 90 | 90 | 90 |
| (209/209) 610 | 1 | 100 | 90 | 90 |
| (210/210) 611 | 1.3 | 30 | 20 | 20 |
| (211/211) 612 | 1.4 | 20 | 30 | 20 |
| (212/212) 613 | 1.4 | 20 | 10 | 20 |
| (213/213) 614 | 1.3 | 10 | 30 | 10 |
| (214/214) | | | | |

TABLE 21

| sample no. | flow rate of gas used (sccm) | | the position where gas introduced(*) | μW power (kW) | inner pressure (mTorr) | bias voltage (V/A) | substrate temperature (°C.) |
|---|---|---|---|---|---|---|---|
| 701 | $SiH_4$ | 500 | A | 3 | 14 | 100/8 | 300 |
| | $CH_4$ | 100 | | | | | |
| | $H_2$ | 1000 | | | | | |
| 702 | $SiH_4$ | 500 | A | 4 | 10 | 120/8 | 300 |
| | $CH_4$ | 5 | | | | | |
| | $H_2$ | 900 | | | | | |
| 703 | $SiH_4$ | 500 | A | 5 | 8 | 0/0 | 300 |
| | $CH_4$ | 50 | | | | | |
| | $H_2$ | 1000 | | | | | |
| 704 | $SiH_4$ | 500 | A | 5 | 7 | 110/10 | 120 |
| | $CH_4$ | 150 | | | | | |
| | $H_2$ | 1200 | | | | | |
| 705 | $SiH_4$ | 500 | A | 6 | 2 | 120/13 | 500 |
| | $CH_4$ | 200 | | | | | |
| | $H_2$ | 1000 | | | | | |
| 706 | $SiH_4$ | 500 | A | 1.5 | 9 | 110/10 | 300 |
| | $CH_4$ | 200 | | | | | |
| | $H_2$ | 1000 | | | | | |
| 707 | $SiH_4$ | 500 | A | 1 | 9 | 120/9 | 280 |
| | $CH_4$ | 250 | | | | | |
| | $H_2$ | 1000 | | | | | |
| 708 | $SiH_4$ | 500 | A | 5 | 0.4 | 150/9 | 280 |
| | $CH_4$ | 60 | | | | | |
| | $H_2$ | 1000 | | | | | |
| 709 | $SiH_4$ | 500 | A | 3.5 | 5 | 130/12 | 350 |
| | $CH_4$ | 800 | | | | | |
| | $H_2$ | 1000 | | | | | |
| 710 | $SiH_4$ | 500 | A | 10 | 2 | 110/15 | 280 |
| | $CH_4$ | 150 | | | | | |
| | $H_2$ | 500 | | | | | |
| 711 | $SiH_4$ | 500 | B | 4 | 0.6 | 110/10 | 300 |
| | $CH_4$ | 25 | | | | | |
| | $H_2$ | 1000 | | | | | |
| 712 | $SiH_4$ | 500 | B | 4 | 3 | 120/10 | 300 |
| | $CH_4$ | 60 | | | | | |
| | $H_2$ | 1000 | | | | | |
| 713 | $SiH_4$ | 500 | B | 5 | 9 | 130/12 | 280 |
| | $CH_4$ | 200 | | | | | |
| | $H_2$ | 950 | | | | | |
| 714 | $SiH_4$ | 500 | B | 4 | 8 | 100/11 | 280 |
| | $CH_4$ | 100 | | | | | |
| | $H_2$ | 1000 | | | | | |

(*)
A: all the gases were introduced through the feed pipe 611.
B: silane gas and $H_2$ gas were introduced through the feed pipe 611 and $CH_4$ gas was introduced through the feed pipe 608.

TABLE 22

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 701 | 10 | 10 | 0.5 | 4 | 100 | 1.0 |
| 702 | 2 | 6 | 0.2 | 3 | 100 | 0.9 |
| 703 | 1 | 11 | 0.6 | 5 | 100 | 1.1 |
| 704 | 10 | 15 | 0.2 | 4 | 100 | 1.2 |
| 705 | 6 | 4.5 | 0.3 | 4 | 100 | 0.95 |
| 706 | 5 | 15 | 0.3 | 6 | 100 | 1.5 |
| 707 | 11 | 9 | 0.4 | 8 | 100 | 1.0 |
| 708 | 0.6 | 9 | 0.5 | 3 | 100 | 1.0 |
| 709 | 7 | 40 | 1.1 | 3 | 100 | 2.2 |
| 710 | 0.1 | 9 | 0.4 | 2 | 100 | 1.0 |
| 711 | 7 | 15 | 0.03 | 0.3 | 100 | 0.5 |
| 712 | 4 | 5 | 0.01 | 0.9 | 100 | 0.4 |
| 713 | 5 | 10 | 0.03 | 0* | 100 | 0.45 |
| 714 | 6 | 8 | 0.05 | 0* | 100 | 0.5 |

*less than detection limit

TABLE 23

| sample no. | flow rate of gas used (sccm) | the position where gas introduced(*) | RF power (kW) | inner pressure (mTorr) | bias voltage (V/A) | substrate temperature (°C.) |
|---|---|---|---|---|---|---|
| 715 | $SiH_4$ 1000<br>$C_2H_2$ 150<br>$H_2$ 5000 | A | 3 | 500 | 0/0 | 300 |

(*) A: silane gas and $H_2$ gas were introduced through the feed pipe 709 and $C_2H_2$ gas was introduced through the feed pipe 710.

TABLE 24

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 715 | 25 | 20 | 0.08 | 12.0 | 100 | 1.1 |

TABLE 25

| sample no. | flow rate of gas used (sccm) | the position where gas introduced(*) | μW power (kW) | inner pressure (mTorr) | bias voltage (V/A) | substrate temperature (°C.) |
|---|---|---|---|---|---|---|
| 801 | $SiH_4$ 500<br>$CH_4$ 100<br>$H_2$ 1000 | A | 4 | 14 | 100/8 | 280 |
| 802 | $SiH_4$ 500<br>$CH_4$ 20<br>$H_2$ 1000 | A | 5 | 7 | 0/0 | 300 |
| 803 | $SiH_4$ 500<br>$CH_4$ 200<br>$H_2$ 900 | A | 3 | 10 | 100/12 | 100 |
| 804 | $SiH_4$ 500<br>$CH_4$ 250<br>$H_2$ 1000 | A | 2 | 11 | 120/10 | 280 |
| 805 | $SiH_4$ 500<br>$CH_4$ 700<br>$H_2$ 500 | B | 4 | 2 | 100/10 | 100 |
| 806 | $SiH_4$ 500<br>$CH_4$ 1000<br>$H_2$ 300 | B | 4 | 5 | 100/11 | 100 |
| 807 | $SiH_4$ 500<br>$CH_4$ 1000<br>$H_2$ 200 | B | 5 | 9 | 120/12 | 100 |

(*)
A: all the gases were introduced through the feed pipe 611.
B: silane gas and $H_2$ gas were introduced through the feed pipe 611 and $CH_4$ gas was introduced through the feed pipe 608.

TABLE 26

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 801 | 47 | 20 | 0.5 | 7 | 100 | 1 |

TABLE 26-continued

| sample no. | the amount of H in film (atomic %) | the amount of C in film (atomic %) | IR intensity ratio C—H/Si—H | the amount of graphite (%) | deposition rate (Å/sec) | characteristic energy (relative value) |
|---|---|---|---|---|---|---|
| 802 | 52 | 15 | 0.2 | 4 | 100 | 1.1 |
| 803 | 68 | 44 | 0.6 | 8 | 100 | 1.3 |
| 804 | 73 | 39 | 0.4 | 10 | 100 | 2.0 |
| 805 | 52 | 25 | 0.03 | 0.3 | 100 | 0.5 |
| 806 | 60 | 30 | 0.03 | 0.5 | 100 | 0.6 |
| 807 | 65 | 37 | 0.02 | 0* | 100 | 0.4 |

*less than detection limit

TABLE 27

| | film-forming conditions | | | | | | |
|---|---|---|---|---|---|---|---|
| | flow rate of gas used (sccm) | μW power (kW) | inner pressure (mTorr) | bias voltage (V/A) | the position where gas introduced(*) | substrate temperature (°C.) | layer thickness (μm) |
| photoconductive layer | formed under the film-forming conditions for samples nos. 711-714 shown in Table 21 | | | | | | 25 |
| surface layer* | $SiH_4$ 500<br>$CH_4$ 700<br>$H_2$ 500 | 4 | 2 | 100/10 | B | 100 | 0.5 |

*the same film-forming conditions as sample no. 805 in Table 25

TABLE 28

| | film-forming conditions | | | | | | |
|---|---|---|---|---|---|---|---|
| | flow rate of gas used (sccm) | μW power (kW) | inner pressure (mTorr) | bias voltage (V/A) | the position where gas introduced(*) | substrate temperature (°C.) | layer thickness (μm) |
| photoconductive layer | formed under the film-forming conditions for samples nos. 701-710 and 715 shown in Tables 21 and 23 | | | | | | 25 |
| surface layer | $SiH_4$ 200<br>$CH_4$ 3000 | 3 | 600 | 0/0 | A | 280 | 0.5 |

TABLE 29

| sample no. (no. of the film-forming condition of photoconductive layer) | charge retentivity (relative value) | dark decay (relative value) | photosensitivity (relative value) | ghost (relative value) |
|---|---|---|---|---|
| 901 (701) | 1 | 100 | 100 | 100 |
| 902 (702) | 1 | 110 | 90 | 90 |
| 903 (703) | 1 | 90 | 100 | 100 |
| 904 (704) | 0.9 | 90 | 100 | 100 |
| 905 (705) | 1 | 90 | 100 | 100 |
| 906 (706) | 0.8 | 100 | 90 | 100 |
| 907 (707) | 1 | 90 | 90 | 100 |
| 908 (708) | 1 | 110 | 100 | 90 |
| 909 (709) | 0.7 | 90 | 90 | 100 |
| 910 (710) | 1 | 100 | 100 | 90 |
| 911 (711) | 1.2 | 75 | 65 | 60 |
| 912 (712) | 1.2 | 75 | 75 | 65 |
| 913 (713) | 1.1 | 80 | 70 | 75 |
| 914 (714) | 1.2 | 75 | 70 | 75 |
| 915 (715) | 0.6 | 130 | 130 | 140 |

TABLE 30

| | film-forming conditions | | | | | | |
|---|---|---|---|---|---|---|---|
| | flow rate of gas used (sccm) | μW power (kW) | inner pressure (mTorr) | bias voltage (V/A) | the position where gas introduced(*) | substrate temperature (°C.) | layer thickness (μm) |
| first layer | $SiH_4$ 500<br>$CH_4$ 100<br>$B_2H_6$ 3000<br>*1 (ppm) | 4 | 5 | 100/10 | A | 280 | 3 |
| second layer | formed under the film-forming conditions for samples nos. 701-714 shown in Table 21 | | | | | | 25 |
| third layer *2 | $SiH_4$ 500<br>$CH_4$ 700<br>$H_2$ 500 | 4 | 2 | 100/10 | B | 100 | 0.5 |

*1: flow ratio (%) against the flow rate of $SiH_4$
*2: the same film-forming conditions as sample no. 805 in Table 25
(*)
A: all the gases were introduced through the feed pipe 611.
B: silane gas, $H_2$ gas (and $B_2H_6$ gas) were introduced through the feed pipe 611 and $CH_4$ gas was introduced through the feed pipe 608.

TABLE 31

| | film-forming conditions | | | | | | |
|---|---|---|---|---|---|---|---|
| | flow rate of gas used (sccm) | μW power (kW) | inner pressure (mTorr) | bias voltage (V/A) | the position where gas introduced(*) | substrate temperature (°C.) | layer thickness (μm) |
| first layer | $SiH_4$ 800<br>$CH_4$ 100<br>$B_2H_6$ 3000<br>* (ppm) | 3 | 500 | 0/0 | A | 280 | 3 |
| second layer | formed under the film-forming conditions for sample no. 715 shown in Table 23 | | | | | | 25 |
| third layer | $SiH_4$ 200<br>$CH_4$ 3000 | 3 | 600 | 0/0 | A | 280 | 0.5 |

*flow ratio (%) against the flow rate of $SiH_4$
(*) A: all the gases were introduced through the feed pipe 611.

TABLE 32

| sample no. (no. of the film-forming condition of photoconductive layer) | charge retentivity (relative value) | dark decay (relative value) | photosensitivity (relative value) | ghost (relative value) |
|---|---|---|---|---|
| 1001 (701) | 1 | 100 | 100 | 100 |
| 1002 (702) | 1 | 100 | 100 | 90 |
| 1003 (703) | 0.9 | 100 | 90 | 100 |
| 1004 (704) | 1 | 110 | 90 | 100 |
| 1005 (705) | 1 | 90 | 90 | 110 |
| 1006 (706) | 0.8 | 90 | 110 | 100 |
| 1007 (707) | 1.1 | 100 | 90 | 110 |
| 1008 (708) | 1 | 110 | 100 | 90 |
| 1009 (709) | 0.9 | 90 | 100 | 90 |
| 1010 (710) | 1 | 100 | 110 | 90 |
| 1011 (711) | 1.2 | 75 | 80 | 75 |
| 1012 (712) | 1.3 | 70 | 75 | 75 |
| 1013 (713) | 1.3 | 70 | 75 | 75 |
| 1014 (714) | 1.2 | 60 | 70 | 80 |
| 1015 (715) | 0.7 | 130 | 150 | 150 |

TABLE 33

| | film-forming conditions | | | | | | | |
|---|---|---|---|---|---|---|---|---|
| | flow rate of gas used (sccm) | | μW power (kW) | inner pressure (mTorr) | bias voltage (V/A) | the position where gas introduced(*) | substrate temperature (°C.) | layer thickness (μm) |
| first layer *1 | $SiH_4$ | 500 | 4 | 8 | 100/11 | B | 280 | 3 |
| | $CH_4$ | 250 | | | | | | |
| | $H_2$ | 1000 | | | | | | |
| | $B_2H_6$ | 3000 (ppm) | | | | | | |
| second layer | formed under the film-forming conditions for samples nos. 701-714 shown in Table 21 | | | | | | | 25 |
| third layer *2 | $SiH_4$ | 500 | 4 | 2 | 100/10 | B | 100 | 0.5 |
| | $CH_4$ | 700 | | | | | | |
| | $H_2$ | 500 | | | | | | |

*1: the film-forming conditions for sample no. 714 shown in Table 21 were employed and $B_2H_6$ was introduced in an amount of 3000 ppm against $SiH_4$.
*2: the same film-forming conditions as sample no. 805 in Table 25
(*) B: silane gas, $H_2$ gas (and $B_2H_6$ gas) were introduced through the feed pipe 611 and $CH_4$ gas was introduced through the feed pipe 608.

TABLE 34

| sample no. (no. of the film-forming condition of photoconductive layer) | charge retentivity (relative value) | dark decay (relative value) | photosensitivity (relative value) | ghost (relative value) |
|---|---|---|---|---|
| 1101 (701) | 1 | 100 | 100 | 100 |
| 1102 (702) | 0.9 | 100 | 110 | 100 |
| 1103 (703) | 0.9 | 80 | 80 | 90 |
| 1104 (704) | 1 | 90 | 80 | 100 |
| 1105 (705) | 1 | 90 | 100 | 100 |
| 1106 (706) | 0.8 | 100 | 90 | 100 |
| 1107 (707) | 1 | 100 | 90 | 100 |
| 1108 (708) | 0.9 | 90 | 100 | 90 |
| 1109 (709) | 1 | 90 | 100 | 100 |
| 1110 (710) | 1 | 100 | 90 | 80 |
| 1111 (711) | 1.2 | 70 | 75 | 65 |
| 1112 (712) | 1.2 | 60 | 75 | 70 |
| 1113 (713) | 1.1 | 65 | 65 | 75 |
| 1114 (714) | 1.2 | 70 | 70 | 70 |

TABLE 35

| | film-forming conditions | | | | | | | |
|---|---|---|---|---|---|---|---|---|
| | flow rate of gas used (sccm) | | μW power (kW) | inner pressure (mTorr) | bias voltage (V/A) | the position where gas introduced(*) | substrate temperature (°C.) | layer thickness (μm) |
| first layer *1 | $SiH_4$ | 500 | 4 | 9 | 100/12 | B | 280 | 3 |
| | $CH_4$ | 250 | | | | | | |
| | $H_2$ | 1000 | | | | | | |
| | $PH_3$ | 4000 (ppm) | | | | | | |
| second layer | formed under the film-forming conditions for samples nos. 701-714 shown in Table 21 | | | | | | | 25 |
| third layer *2 | $SiH_4$ | 500 | 4 | 2 | 100/10 | B | 100 | 0.5 |
| | $CH_4$ | 700 | | | | | | |
| | $H_2$ | 500 | | | | | | |

*1: the film-forming conditions for sample no. 714 shown in Table 21 were employed and $PH_3$ was introduced in an amount of 4000 ppm against $SiH_4$.
*2: the same film-forming conditons as sample no. 805 in Table 25
(*) B: silane gas, $H_2$ gas (and $PH_3$ gas) were introduced through the feed pipe 611 and $CH_4$ gas was introduced through the feed pipe 608.

TABLE 36

| sample no. (no. of the film-forming condition of photoconductive layer) | charge retentivity (relative value) | dark decay (relative value) | photosensitivity (relative value) | ghost (relative value) |
|---|---|---|---|---|
| 1201 (701) | 1 | 100 | 100 | 100 |
| 1202 (702) | 0.9 | 100 | 110 | 90 |
| 1203 (703) | 1 | 100 | 100 | 110 |
| 1204 (704) | 1.1 | 90 | 100 | 100 |
| 1205 (705) | 1 | 100 | 90 | 110 |
| 1206 (706) | 0.8 | 100 | 90 | 100 |
| 1207 (707) | 1.1 | 90 | 90 | 100 |
| 1208 (708) | 1 | 110 | 110 | 90 |
| 1209 (709) | 1 | 100 | 100 | 90 |
| 1210 (710) | 0.9 | 100 | 90 | 110 |
| 1211 (711) | 1.3 | 60 | 60 | 80 |
| 1212 (712) | 1.2 | 80 | 75 | 75 |
| 1213 (713) | 1.3 | 50 | 75 | 60 |
| 1214 (714) | 1.4 | 50 | 60 | 65 |

TABLE 37

| | film-forming conditions | | | | | | | |
|---|---|---|---|---|---|---|---|---|
| | flow rate of gas used (sccm) | | μW power (kW) | inner pressure (mTorr) | bias voltage (V/A) | the position where gas introduced(*) | substrate temperature (°C.) | layer thickness (μm) |
| first layer *1 | $SiH_4$ | 500 | 4 | 8 | 100/11 | B | 280 | 3 |
| | $CH_4$ | 250 | | | | | | |
| | $H_2$ | 1000 | | | | | | |
| | $B_2H_6$ | 3000 (ppm) | | | | | | |
| second layer *2 | $SiH_4$ | 500 | 4 | 8 | 100/11 | B | 280 | 25 |
| | $CH_4$ | 250 | | | | | | |
| | $H_2$ | 1000 | | | | | | |
| | $B_2H_6$ | 1 (ppm) | | | | | | |
| third layer | formed under the film-forming conditions for samples nos. 801–807 shown in Table 25 | | | | | | | 0.5 |

*1: the film-forming conditions for sample no. 714 shown in Table 21 were employed and $B_2H_6$ was introduced in an amount of 3000 ppm against $SiH_4$.
*2: the film-forming conditions for sample no. 714 shown in Table 21 were employed and $B_2H_6$ was introduced in an amount of 1 ppm against $SiH_4$.

TABLE 38

| sample no. (no. of the film-forming condition of surface layer) | charge retentivity (relative value) | dark decay (relative value) | photosensitivity (relative value) | ghost (relative value) |
|---|---|---|---|---|
| 1301 (801) | 1 | 100 | 100 | 100 |
| 1302 (802) | 0.9 | 90 | 110 | 110 |
| 1303 (803) | 1 | 90 | 100 | 100 |
| 1304 (804) | 1 | 100 | 90 | 100 |
| 1305 (805) | 1.5 | 50 | 50 | 30 |
| 1306 (806) | 1.4 | 40 | 50 | 45 |
| 1307 (807) | 1.3 | 45 | 30 | 40 |

TABLE 39

| | film-forming conditions | | | | | | | |
|---|---|---|---|---|---|---|---|---|
| | flow rate of gas used (sccm) | | μW power (kW) | inner pressure (mTorr) | bias voltage (V/A) | the position where gas introduced(*) | substrate temperature (°C.) | layer thickness (μm) |
| first layer *1 | $SiH_4$ | 500 | 4 | 8 | 100/11 | B | 280 | 3 |
| | $CH_4$ | 250 | | | | | | |
| | $H_2$ | 1000 | | | | | | |
| | $PH_3$ | 4000 (ppm) | | | | | | |
| second layer *2 | $SiH_4$ | 500 | 4 | 8 | 100/11 | B | 280 | 25 |
| | $CH_4$ | 250 | | | | | | |
| | $H_2$ | 1000 | | | | | | |
| | $B_2H_6$ | 1 (ppm) | | | | | | |
| third layer | formed under the film-forming conditions for samples nos. 801-807 shown in Table 25 | | | | | | | 0.5 |

*1: the film-forming conditions for sample no. 714 shown in Table 21 were employed and $PH_3$ was introduced in an amount of 4000 ppm against $SiH_4$.
*2: the film-forming conditions for sample no. 714 shown in Table 21 were employed and $B_2H_6$ was introduced in an amount of 1 ppm against $SiH_4$.

TABLE 40

| sample no. (no. of the film-forming condition of surface layer) | charge retentivity (relative value) | dark decay (relative value) | photosensitivity (relative value) | ghost (relative value) |
|---|---|---|---|---|
| 1401 (801) | 1 | 100 | 100 | 100 |
| 1402 (802) | 0.9 | 100 | 90 | 90 |
| 1403 (803) | 1 | 90 | 110 | 100 |
| 1404 (804) | 1 | 100 | 100 | 110 |
| 1405 (805) | 1.4 | 30 | 30 | 50 |
| 1406 (806) | 1.5 | 30 | 30 | 30 |
| 1407 (807) | 1.5 | 20 | 30 | 30 |

What is claim is:

1. An electrophotographic image-forming member which comprises a substrate for electrophotography and a light receiving layer being disposed on said substrate, said light receiving layer comprising a photoconductive layer formed of a non-single-crystal carbide film containing silicon atoms as a matrix, carbon atoms in an amount of 5 to 15 atomic % and hydrogen atoms in an amount in a proportion of 1% or less per unit volume and having an intensity ratio of 0.01 to 0.05 between the C—H bond stretching mode and the Si—H bond stretching mode in an infrared absorption spectrum.

2. An electrophotographic image-forming member according to claim 1, wherein said light receiving layer further comprises a charge injection inhibition layer being disposed between said substrate and said photoconductive layer.

3. An electrophotographic image-forming member according to claim 2, wherein said charge injection inhibition layer is formed of a doped non-single-crystal silicon-containing film selected from the group consisting of a doped non-single-crystal hydrogenated silicon film, a doped non-single-crystal silicon oxide film, a doped non-single-crystal silicon nitride film and a doped non-single-crystal silicon carbide film.

4. An electrophotographic image-forming member according to claim 2, wherein said charge injection inhibition layer is formed of a doped non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum.

5. An electrophotographic image-forming member according to claim 4, wherein said doped non-single-crystal silicon carbide film contains atoms of an element of the group III elements and the group V elements of the Periodic Table.

6. An electrophotographic image-forming member according to claim 1, wherein said light receiving layer further comprises a surface layer being disposed on said photoconductive layer.

7. An electrophotographic image-forming member according to claim 6, wherein said surface layer is formed of a non-single-crystal silicon carbide film containing silicon atoms as a matrix, carbon atoms in an amount of 20 to 40 atomic % and hydrogen atoms in an amount of 50 to 70 atomic and containing graphite structure domains in a proportion of 1% or less per unit volume.

8. An electrophotographic image-forming member according to claim 7, wherein the light receiving layer further comprises a charge injection inhibition layer being disposed between the substrate and the photoconductive layer.

9. An electrophotographic image-forming member according to claim 8, wherein said charge injection inhibition layer is formed of a doped non-single-crystal silicon-containing film selected from the group consisting of a doped non-single-crystal hydrogenated silicon film, a doped non-single-crystal silicon oxide film, a doped non-single-crystal silicon nitride film and a doped non-single-crystal silicon carbide film.

10. An electrophotographic image-forming member according to claim 8, wherein said charge injection inhibition layer is formed of a doped non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum.

11. An electrophotographic image-forming member according to claim 10, wherein said doped non-single-crystal silicon carbide film contains atoms of an element of the group III elements and the group V elements of the Periodic Table.

12. An electrophotographic image-forming member according to claim 1, wherein said non-single-crystal silicon carbide film contains atoms of an element selected from the group consisting of the group III elements and the group V element of the Periodic Table.

13. An electrophotographic image-forming member according to claim 12, wherein the light receiving layer further comprises a charge injection inhibition layer being disposed between the substrate and the photoconductive layer.

14. An electrophotographic image-forming member according to claim 13, wherein said charge injection inhibition layer is formed of a doped non-single-crystal silicon-containing film selected from the group consisting of a doped non-single-crystal hydrogenated silicon film, a doped non-single-crystal silicon oxide film, a doped non-single-crystal silicon nitride film and a doped non-single-crystal silicon carbide film.

15. An electrophotographic image-forming member according to claim 13, wherein said charge injection inhibition layer is formed of a doped non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum.

16. An electrophotographic image-forming member according to claim 15, wherein said doped non-single-crystal silicon carbide film contains atoms of an element of the group III elements and the group V elements of the Periodic Table.

17. An electrophotographic image-forming member according to claim 12, wherein a surface layer being disposed on said photoconductive layer.

18. An electrophotographic image-forming member according to claim 17, wherein said surface layer is formed of a non-single-crystal silicon carbide film containing silicon atoms as a matrix, carbon atoms in an amount of 20 to 40 atomic % and hydrogen atoms in an amount of 50 to 70 atomic and containing graphite structure domains in a proportion of 1% or less per unit volume.

19. An electrophotographic image-forming member according to claim 18, wherein the light receiving layer further comprises a charge injection inhibition layer being disposed between the substrate and the photoconductive layer.

20. An electrophotographic image-forming member according to claim 19, wherein said charge injection inhibition layer is formed of a doped non-single-crystal silicon-containing film selected from the group consisting of a doped non-single-crystal hydrogenated silicon film, a doped non-single-crystal silicon oxide film, a doped non-single-crystal silicon nitride film and a doped non-single-crystal silicon carbide film.

21. An electrophotographic image-forming member according to claim 19, wherein said charge injection inhibition layer is formed of a doped non-single-crystal silicon carbide film containing silicon atoms as a matrix, carbon atoms in an amount of 5 to 15 atomic % and hydrogen atoms in an amount of 1 to 10 atomic %, containing graphite structure domains in a proportion of 1% or less per unit volume and having an intensity ratio of 0.01 to 0.05 between the C—H bond stretching mode and the Si—H bond stretching mode in an infrared absorption spectrum.

22. An electrophotographic image-forming member according to claim 21, wherein said doped non-single-crystal silicon carbide film contains atoms of an element of the group III elements and the group V elements of the Periodic Table.

23. An electrophotographic image-forming process comprising the steps of:

(a) applying an electric field to the electrophotographic image-forming member of claim 1: and (b) applying an electromagentic wave to said electrophotographic image-forming member thereby forming an electrostatic image.

* * * * *

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

TITLE PAGE

IN [57] ABSTRACT

Line 12, "adsorption" should read --absorption--.
Line 18, "systems" should read --system--.

COLUMN 1

Line 48, "(RF PCVD" should read --(RF-PCVD--.

COLUMN 2

Line 67, "this" should be deleted.

COLUMN 3

Line 5, "increase" should read --an increase--.
Line 6, "a" should be deleted.

COLUMN 4

Line 2, "systems" should read --system--.

COLUMN 6

Line 28, "process (hereinafter referred to as" should read --process.--.
Line 29 should be deleted.
Line 47, "of" should read --to--.

COLUMN 8

Line 13, "And the" should read --The--.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 9

Line 36, "thought" should read --postulated--.
Line 42, "be by" should read --be expressed by--.
Line 65, "In this" should read --¶ In this--.

COLUMN 10

Line 3, "

$$\bar{x} = \frac{1}{NO}\int_0^x x\left(\frac{dn_h}{dx}\right)dx - \frac{1}{NO}\, x\, NO_h \exp\left(-\frac{x}{W_h}\right)$$

$$= W_h\left(1 - \exp\left(-\frac{x}{W_h}\right)\right)$$

"

should read

-- $$\bar{x} = \frac{1}{n_0}\int_0^x x\left(-\frac{dn_h}{dx}\right)dx + \frac{1}{n_0}\, x\, n_{0h} \exp\left(-\frac{x}{W_h}\right)$$

$$= W_h\left\{1 - \exp\left(-\frac{x}{W_h}\right)\right\}$$ --.

Line 12, "

$$J_h = \frac{eFW_h}{L}\left(1 - \exp\left(\frac{x}{W_h}\right)\right)$$

"

should read

-- $$J_h = \frac{eFW_h}{L}\left(1 - \exp\left(-\frac{x}{W_h}\right)\right)$$ --.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 10

Line 50, "what" should read --what is--.
Line 57, "C" should read --c-- and "V" should read --v--.

COLUMN 11

Line 57, "three dimensional" should read --three-dimensional--.

COLUMN 12

Line 5, "as" should read --a--.
Line 13, "what" should read --what is-- and "as" should read --as is--.
Line 36, "what" should read --what is--.
Line 37, "each" should read --each of the--.
Line 40, "film i.e." should read --film, i.e.--.

COLUMN 13

Line 40, "order desired," should read --order for a a-SiC:H film to exhibit electric characteristics as desired,--.

COLUMN 14

Line 28, "an donor" should read --a donor--.

COLUMN 15

Line 61, "avalanche like" should read --avalanche-like--.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 16

Line 54, "Every" should read --All--.

COLUMN 17

Line 1, "In alternative" should read --Alternatively--.

COLUMN 18

Line 29, "exhibit" should read --exhibits--.

COLUMN 19

Line 23, "space 601" should read --space 606--.
Line 37, "Lay 103" should read --Layer 103--.
Line 49, "Firstly," should read --First,--.
Line 52, "made rotating" should read --made to rotate--.

COLUMN 20

Line 5, "as" hydrogen" should read --as "hydrogen--.
Line 13, "reason. That is, when" should read --reason: when--.
Line 17, "or/and" should read --and/or--.
Line 32, "atoms-imparting" should read --atom-imparting--.
Line 39, "become contributing" should read --contribute--.
Line 40, "prove" should read --proving--.
Line 45, "These knowledges" should read --This knowledge--.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 21

Line 1, "decompassed" should read --decomposed--.
Line 21, "in stead" should read --instead--.
Line 47, "time" should read --times--.

COLUMN 22

Line 51, "examples" should read --example--.

COLUMN 23

Line 43, "silicon $C_3H_6$," should read --silicon carbide film, there is used $CH_4$, $C_2H_6$, $C_3H_8$, $C_2H_4$, $C_3H_6$,--.
Line 57, "be" should be deleted.
Line 58, "consisting" should read --consisting of--.

COLUMN 24

Line 15, "layer 103" should read --layer 102--.
Line 57, "content" should read --content of--.
Line 64, "in alternative," should read --alternatively,--.

COLUMN 25

Line 29, "2 inch" should read --2 inches--.
Line 35, "places." should read --plates.--.
Line 60, "Firstly," should read --First,--.

COLUMN 26

Line 18, "the fewer," should be deleted.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 26

Line 26, "is" should read --are--.
Line 38, "that" should read --than--.
Line 48, "2 inch" should read --2 inches--.
Line 50, "holder" should read --holder 703'--.
Line 58, "Firstly," should read --First,--.

COLUMN 27

Line 6, "$70_2$extending" should read --702 extending--.
Line 51, "Sample No. 115" should read --Sample No. 015--.

COLUMN 28

Line 3, "Firstly," should read --First,--.
Line 9, "what" should read --what is--.
Line 21, "electric "$P_3$"." should read --electric potential decreases to be the value of Ve at the position "$P_3$".--.
Line 49, "what" should read --what is--.

COLUMN 29

Line 23, "inch" should read --inches--.
Line 29, "places." should read --plates.--.
Line 34, "were" should read --are--.
Line 54, "that" should read --than--.
Line 64, "2 inch" should read --2 inches--.

COLUMN 30

Line 5, "Firstly," should read --First,--.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 30

Line 12, "$H_2$gas" should read --$H_2$ gas--.
Line 59, "were" should read --are--.
Line 62, "what" should read --what is--.

COLUMN 31

Line 29, "were" should read --are--.
Line 32, "what" should read --what is--.

COLUMN 32

Line 1, "what" should read --what is--.
Line 33, "what" should read --what is--.
Line 63, "inch" should read --inches--.

COLUMN 33

Line 1, "places." should read --plates.--.
Line 6, "were" should read --are--.
Line 36, "2 inch" should read --2 inches--.

COLUMN 34

Line 1, "were" should read --are--.
Line 37, "were" should read --are--.

COLUMN 35

Line 10, "were" should read --are--.
Line 12, "what" should read --what is--.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 35

Line 48, "were" should read --are--.
Line 50, "what" should read --what is--.

COLUMN 36

Line 15, "Tables 33." should read --Table 33.--.
Line 19, "were" should read --are--.
Line 21, "what" should read --what is--.
Line 54, "Tables 35" should read --Table 34--.
Line 57, "were" should read --are--.
Line 59, "what" should read --what is--.

COLUMN 37

Line 23, "Tables 37" should read --Table 37--.
Line 27, "were" should read --are--.
Line 29, "what" should read --what is--.

COLUMN 38

Line 18, "Tables 39" should read --Table 39--.
Line 22, "were" should read --are--.
Line 24, "what" should read --what is--.

COLUMN 53

TABLE 28, "μW power (kW)" should read --RF power (kW)--.

UNITED STATES PATENT AND TRADEMARK OFFICE

CERTIFICATE OF CORRECTION

PATENT NO. : 5,190,838

DATED : March 2, 1993

INVENTOR(S) : KEISHI SAITOH, ET AL.

It is certified that error appears in the above-identified patent and that said Letters Patent is hereby corrected as shown below:

COLUMN 61

Line 38, "claim" should read --claimed--.
Line 46, "amount in" should read --amount of 1 to 10 atomic %, containing graphite structure domains in--.

COLUMN 62

Line 59, "atomic" should read --atomic %--.

COLUMN 64

Line 14, "atomic" should read --atomic %--.

Signed and Sealed this

Eighth Day of March, 1994

Bruce Lehman

*Attest:*

BRUCE LEHMAN

*Attesting Officer*

*Commissioner of Patents and Trademarks*